US007530733B2

(12) United States Patent
Louie

(10) Patent No.: US 7,530,733 B2
(45) Date of Patent: May 12, 2009

(54) WATCH-WINDING APPARATUS

(75) Inventor: Lip Man Louie, Kowloon (CN)

(73) Assignee: Hero Team Corporation Limited, Kowloon, Hong Kong (CN)

( * ) Notice: Subject to any disclaimer, the term of this patent is extended or adjusted under 35 U.S.C. 154(b) by 174 days.

(21) Appl. No.: 11/440,884

(22) Filed: May 25, 2006

(65) Prior Publication Data

US 2007/0159032 A1 Jul. 12, 2007

Related U.S. Application Data

(63) Continuation-in-part of application No. 11/326,786, filed on Jan. 6, 2006.

(51) Int. Cl.
*G04B 3/00* (2006.01)
*G04C 1/04* (2006.01)

(52) U.S. Cl. ..... 368/206; 81/7.5

(58) Field of Classification Search ..... 368/206–210
See application file for complete search history.

(56) References Cited

U.S. PATENT DOCUMENTS

| | | | | |
|---|---|---|---|---|
| 4,044,545 | A * | 8/1977 | Shimizu | 368/22 |
| 6,745,588 | B2 * | 6/2004 | Kahler | 62/246 |
| 2003/0228906 | A1 * | 12/2003 | Walker et al. | 463/40 |
| 2005/0254352 | A1 * | 11/2005 | Wolf et al. | 368/206 |

* cited by examiner

*Primary Examiner*—Edwin A. Leon
*Assistant Examiner*—Thanh S Phan
(74) *Attorney, Agent, or Firm*—Alix, Yale & Ristas, LLP

(57) ABSTRACT

An improved watch-winding apparatus comprising: a bottom support; a body; a lid cover with a glass window; and a plurality of tabbed spring cushions. A solid direct drive system drives the rotating tray. An electronic system keeps the rotating tray swinging per the intended program. Where a drawer is employed, a catch lock mechanism is also provided to prevent the drawer from automatically sliding open.

7 Claims, 35 Drawing Sheets

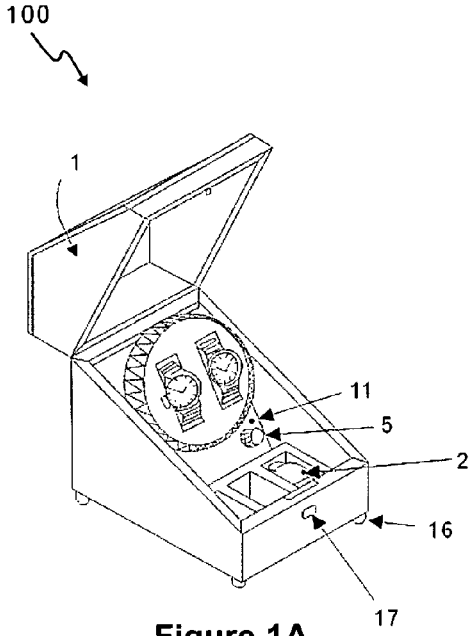
Figure 1A
PRIOR ART
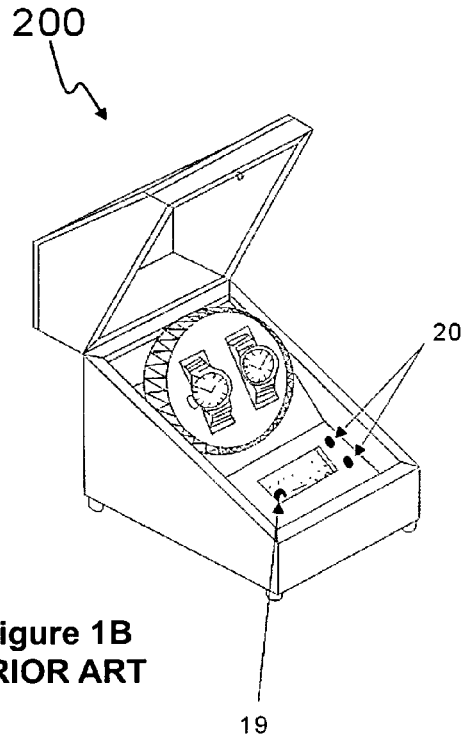
Figure 1B
PRIOR ART
Figure 2
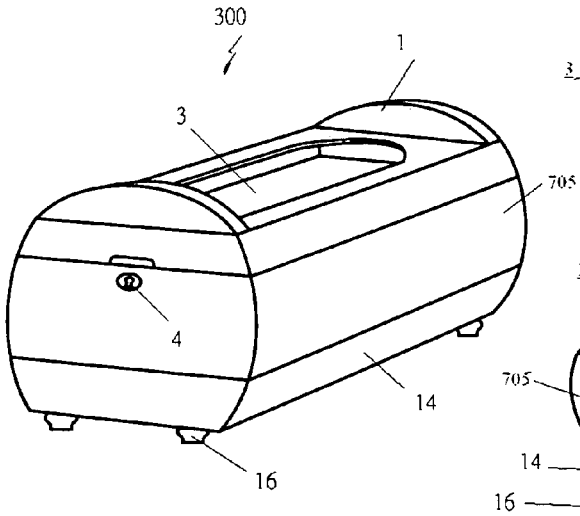
Figure 3
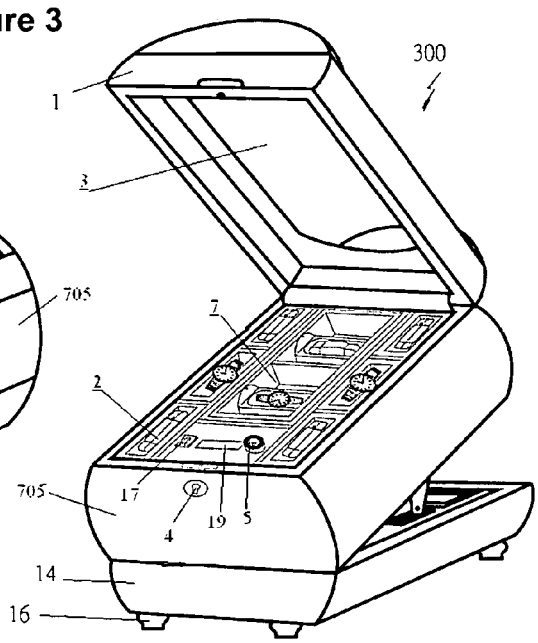

Direct Drive Gear Box - Part List

| | | |
|---|---|---|
| 102 | Lower case | |
| 103 | transmission parts | |
| 105 | Motor Power Cord | |
| 106 | PVC | |
| 108 | Copper Sleeve | |
| 109 | Upper Case | |
| 110 | Ø2.2 Steel Shaft | |
| 111 | Ø2.5 Steel Shaft | |
| 113 | Stainless Steel Main Shaft | |
| 115 | Stainless Steel S. Washer | |
| 116 | Stainless Steel B. Washer | |
| 118 | Safety Gear | |
| 119 | Safety Gear | |
| 120 | Main Shaft Sleeve | |
| 121 | 2.6*12KT Screw | |
| 122 | 3*11PM Screw | |
| 123 | M3 Screw | |
| 124 | 2.5*4.5PM Screw | |
| 125 | 2.3*8PB Screw | |
| 126 | Stainless Steel Spacer | |
| 127 | Spring washer | |
| 128 | Split lock washer | |
| 90 | Motor | |
| 91 | Stainless Steel Sleeve | |
| 92 | Helix Gear | |
| 93 | Helical Gear | |
| 94 | Worm Shaft | |
| 95 | Solid Shaft Part | |
| 96 | Stainless Steel Spring | |
| 97 | Motor worm shaft | |

Figure 8-1

Gear Box with Timing Belt - Part List

| | |
|---|---|
| 201 | Input Worm Gear |
| 202 | Timing Belt |
| 203 | Motor |
| 204 | Upper Case |
| 205 | Input Pulley |
| 206 | Input Shaft |
| 207 | Lower Case |
| 208 | Suspension Plate |
| 209 | Plastic Ring |
| 210 | Output Shaft |
| 211 | Plastic Washer |
| 212 | Spring |
| 213 | Output Gear |
| 214 | Main Shaft |
| 215 | Copper Sleeve |
| 216 | Output Worm Gear |
| 217 | Input Helical Gear |
| 218 | Bearing |
| 219 | Reducer Pulley |

Figure 8-2

| FIG13/FIG14 component & connector description table | | | | | |
|---|---|---|---|---|---|
| TAG | PACKAGE | MODEL | NAME | FUNCTION | ACTIVITY |
| C1 | RB-.1/.2 | 220 | ELECTROLYTE CAPACITOR | FILTER | PREVENT FROM ELECTROMAGETISM RADIALIZATION |
| BAT | SIP-2 | C3-SOCKET | 2 PIN SOCKET | BATTERY INPUT | RECEIVE THE ENERGY FROM BATTERY |
| DP | SIP-2 | C3-SOCKET | 2 PIN SOCKET | REDUNDANT PHOTODIODE INPUT | RECEIVE THE DIRECTION SIGNAL FROM PHOTODIODE |
| DS | SIP-2 | C3-SOCKET | 2 PIN SOCKET | REDUNDANT PHOTODIODE INPUT | RECEIVE THE PARKING SIGNAL FROM PHOTODIODE |
| IN | SIP-3 | C3-SOCKET | 2 PIN SOCKET | DC POWER INPUT | MASTER POWER INPUT |
| OUT | SIP-3 | C3-SOCKET | 3 PIN SOCKET | DC POWER OUTPUT | POWER TO CONTROL BOARD |
| K1 | SIP-2 | C3-SOCKET | 2 PIN SOCKET | REDUNDANT INPUT CONNECTOR | BOND INPUT RESERVE |
| K2 | SIP-2 | C3-SOCKET | 2 PIN SOCKET | REDUNDANT INPUT CONNECTOR | BOND INPUT RESERVE |
| KB | SIP-3 | C3-SOCKET | 3 PIN SOCKET | REDUNDANT INPUT CONNECTOR | BOND INPUT RESERVE |
| LED1 | SIP-2 | C3-SOCKET | 2 PIN SOCKET | REDUNDANT LED INPUT | DRIVE LED |
| LED2 | SIP-2 | C3-SOCKET | 2 PIN SOCKET | REDUNDANT LED INPUT | DRIVE LED |
| SENSOR | SIP-5 | C3-SOCKET | 5 PIN SOCKET | CONNECT TO CONTROL BOARD (FIG.16) | OUTPUT DIRECTION,PARKING AND POWER DOWN SIGNAL |
| SW1 | SIP-4 | C3-SOCKET | 4 PIN SOCKET | POWER SWITCH CONNECTOR | SWITCH MASTER POWER AND.CREATE POWER DOWN SIGNAL |
| LOCK1 | RZ-6 | RZ-6/5V | RELAY | POWER LOCK & UNLOCK | ACHIEVE LEVEL PARKING (Co-ordinate with IC Programming) |
| P | TO92C | ATS177 | HALL SENSOR | LOCATION SENSOR | RETURN THE PARKING SIGNAL |
| S | TO92C | ATS177 | HALL SENSOR | LOCATION SENSOR | RETURN THE CHANGE DIRCTION SIGNAL |
| R1 | AXIAL-0.2 | 220 | RESISTOR | ADJUST VOLTAGE | PROTECT PHOTODIODE |
| R2 | AXIAL-0.2 | 220 | RESISTOR | ADJUST VOLTAGE | PROTECT PHOTODIODE |
| R3 | AXIAL-0.2 | 120 | RESISTOR | ADJUST VOLTAGE | PROTECT PHOTODIODE |
| R4 | AXIAL-0.2 | 120 | RESISTOR | ADJUST VOLTAGE | PROTECT PHOTODIODE |

Figure 13 is a layout of the double sided Printed Circuit Board (PCB) of the sensor circuitry which controls the auto-level parking, and change of direction of the Gyro-Winder as described per Fig. 9, Fig. 9-1, Fig. 9-2 and Fig.9-3; and the 8-watch swivel center display as described per Fig. 22-A, 22-B, 22-C.

Figure 14 is the electronic/electrical flowchart diagram explaining the functioning of the Printed Circuit Board as appeared on Figure 13.

FIGURE 15

| FIG16/FIG17 Component & Connector Description Table | | | | | | | |
|---|---|---|---|---|---|---|---|
| TAG | PACKAGE | MODEL | NAME | CIRCULAR MOTION WINDER (per Fig.4) | | GYRO MOTION WINDER (Per FIG.3) | |
| | | | | FUNCTION | ACTIVITY | FUNCTION | ACTIVITY |
| U1 | DIP28S | ATMEGA48 | MCU (CPU) | STORAGE AND RUN THE PROGRAM | TIMER,DISPLAY AND MOTOR DRIVE | STORAGE AND RUN THE PROGRAM | TIMER,DISPLAY AND MOTOR DRIVE |
| C1 | RESISTOR1 | 330U | ELECTROLYTE CAPACITOR | FILTER | PREVENT FROM ELECTROMAGETISM RADIALIZATION | FILTER | PREVENT FROM ELECTROMAGETISM RADIALIZATION |
| C2 | RESISTOR2 | 104 | CAPACITOR | FILTER | | FILTER | |
| C3 | RESISTOR3 | 104 | CAPACITOR | FILTER | | FILTER | |
| C4 | RESISTOR4 | 104 | CAPACITOR | FILTER | | FILTER | |
| DC | SIP-3 | C3-SOCKET | 3 PIN SOCKET | DC POWER INPUT | MASTER POWER INPUT | DC POWER INPUT | MASTER POWER INPUT |
| JMP | SIP-2 | C3-SOCKET | 2 PIN SOCKET | REDUNDANT JUMPER | INPUT RESERVE | REDUNDANT JUMPER | INPUT RESERVE |
| K1 | SIP-8 | C3-SOCKET | 8 PIN SOCKET | 12 FUNCTIONS SWITCH CONNECTOR | RECEIVE THE FUNCTION SELECT FROM SWITCH | RESERVE | NONE |
| K2 | SIP-5 | C3-SOCKET | 5 PIN SOCKET | 12 FUNCTIONS SWITCH CONNECTOR | | CONNECTOR TO FIG.13 | RECEIVE DIRECTION,PARKING AND POWER DOWN SIGNAL |
| K3 | SIP-2 | C3-SOCKET | 2 PIN SOCKET | REDUNDANT INPUT CONNECTOR | INPUT RESERVE | REDUNDANT INPUT CONNECTOR | INPUT RESERVE |
| K4 | SIP-2 | C3-SOCKET | 2 PIN SOCKET | REDUNDANT INPUT CONNECTOR | INPUT RESERVE | REDUNDANT INPUT CONNECTOR | INPUT RESERVE |
| K5 | SIP-2 | C3-SOCKET | 2 PIN SOCKET | REDUNDANT OUTPUT CONNECTOR | OUTPUT RESERVE | REDUNDANT OUTPUT CONNECTOR | OUTPUT RESERVE |
| K6 | SIP-2 | C3-SOCKET | 2 PIN SOCKET | REDUNDANT OUTPUT CONNECTOR | OUTPUT RESERVE | REDUNDANT OUTPUT CONNECTOR | OUTPUT RESERVE |
| LCD1 | SIP-6 | C3-SOCKET | 6 PIN SOCKET | LCD DATA OUTPUT | SEND DISPLAY DATA TO LCD | LCD DATA OUTPUT | SEND DISPLAY DATA TO LCD |
| LCD2 | SIP-5 | C3-SOCKET | 5 PIN SOCKET | LCD POWER OUTPUT | LCD POWER | LCD POWER OUTPUT | LCD POWER |
| LED | SIP-2 | C3-SOCKET | 2 PIN SOCKET | LED DRIVE OUTPUT | MAKE LED FLASH | LED DRIVE OUTPUT | LED FLASH |
| M1 | SIP-2 | C3-SOCKET | 2 PIN SOCKET | MOTOR DRIVE OUTPUT | CW,CCW, BOTH (Motor Direction control) | MOTOR DRIVE OUTPUT | SWING ACTION/DIRECTION CONTROL |
| BAT | SIP-2 | C3-SOCKET | 2 PIN SOCKET | BATTERY INPUT | RECEIVE THE ENERGY FROM BATTERY | BATTERY INPUT | RECEIVE THE ENERGY FROM BATTERY |
| S1 | SIP-2 | C3-SOCKET | 2 PIN SOCKET | POWER SWITCH CONNECTOR | SWITCH THE POWER | POWER SWITCH CONNECTOR | SWITCH THE POWER |
| TP | SOCKET | C3-SOCKET | 1 PIN SOCKET | TEST POINT | TEST POINT FOR FIX UP | TEST POINT | TEST POINT FOR FIX UP |
| Q1 | TO92C | 8550 | TRANSISTOR | COMPLEX TRANSISTOR MOTOR DRIVER | CONTROL BY MCU AND DRIVE TO MOTOR | COMPLEX TRANSISTOR MOTOR DRIVER | CONTROL BY MCU AND DRIVE TO MOTOR |
| Q2 | TO92C | 8550 | TRANSISTOR | | | | |
| Q3 | TO92C | 9014 | TRANSISTOR | | | | |
| Q4 | TO92C | 9014 | TRANSISTOR | | | | |
| Q5 | TO92C | 8050 | TRANSISTOR | | | | |
| Q6 | TO92C | 8050 | TRANSISTOR | | | | |
| R1 | RESISTOR1 | 1K5 | RESISTOR | | | | |
| R2 | RESISTOR2 | 100 | RESISTOR | | | | |
| R3 | RESISTOR3 | 1K5 | RESISTOR | | | | |
| R4 | RESISTOR4 | 100 | RESISTOR | | | | |
| R5 | RESISTOR5 | 330 | RESISTOR | ADJUST VOLTAGE | PROTECT LCD | ADJUST VOLTAGE | PROTECTE LCD |
| R7 | RESISTOR6 | 220 | RESISTOR | ADJUST VOLTAGE | PROTECT LED | ADJUST VOLTAGE | PROTECTE LED |
| 100uh | RESISTOR1 | 100uh | INDUCTOR | FILTER | PREVENT FROM ELECTROMAGETISM RADIALIZATION | FILTER | PREVENT FROM ELECTROMAGETISM RADIALIZATION |

Figure 16 is a layout of the Printed Circuit Board (PCB) of the winder circuitry which controls the winder operations Figure 17 is the electronic/electrical flowchart diagram explaining the functioning of the Printed Circuit Board as appeared on Figure 16.

FIGURE 18

Figure 19A
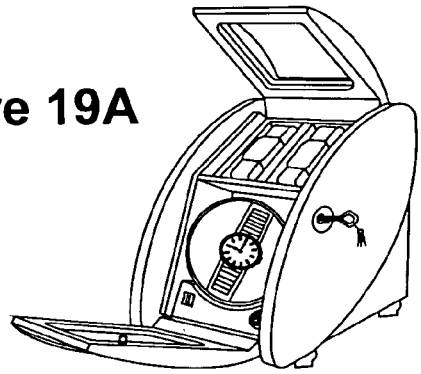
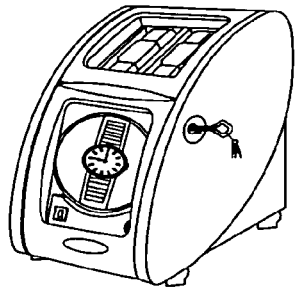
Figure 19B
Figure 20A
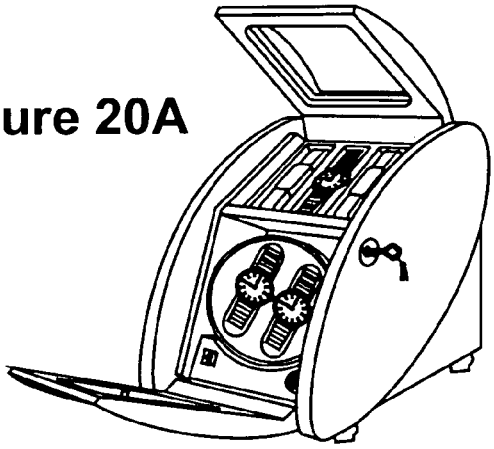
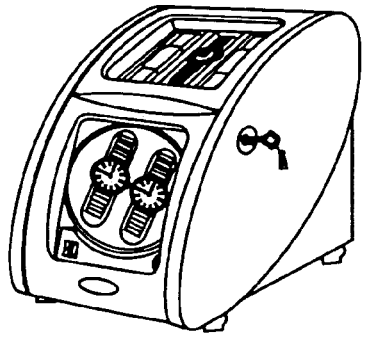
Figure 20B
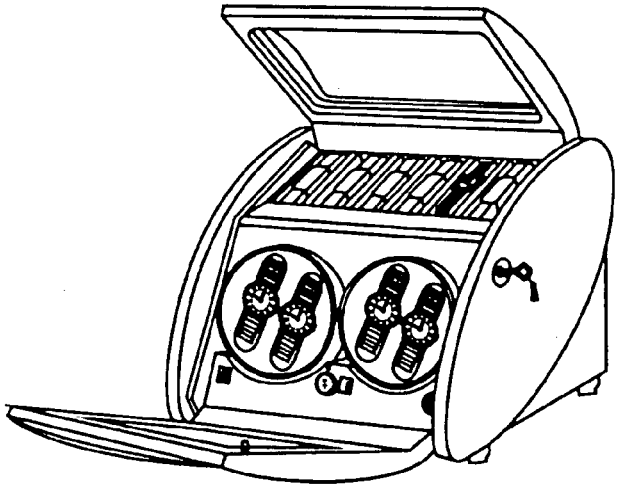
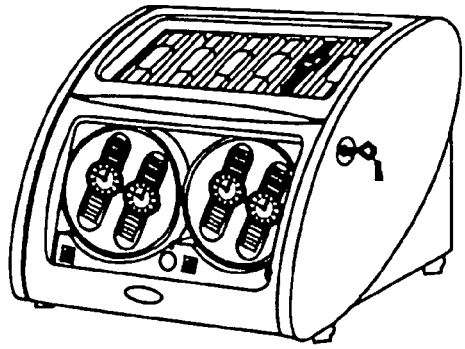
Figure 20-1A Figure 20-1B Figure 21A
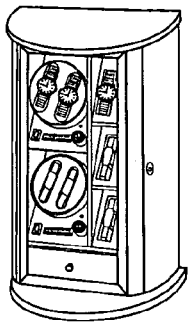
Figure 21B
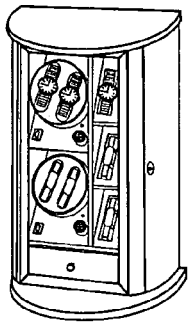
Figure 21C
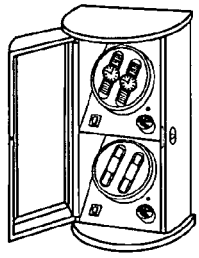
Figure 21D
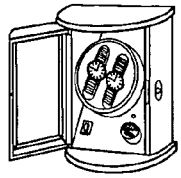
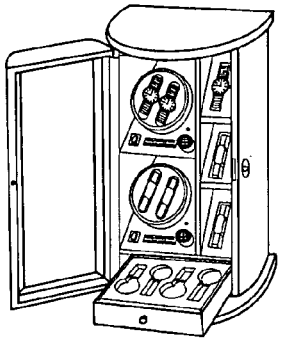
Figure 21E
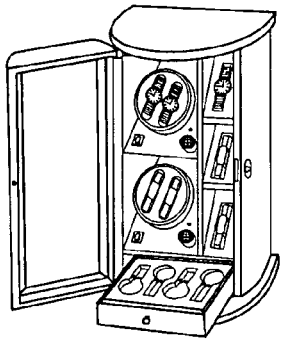
Figure 21F
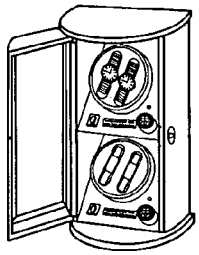
Figure 21G
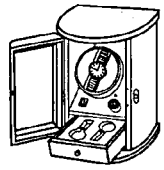
Figure 21H
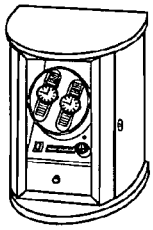
Figure 21I
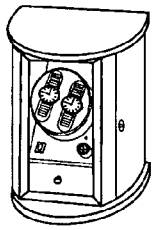
Figure 21J
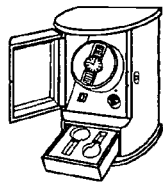
Figure 21K
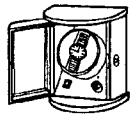
Figure 21L
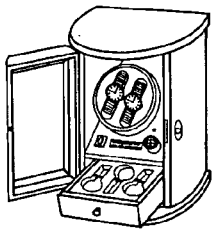
Figure 21M
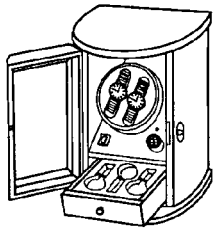
Figure 21N
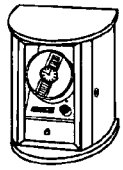
Figure 21O
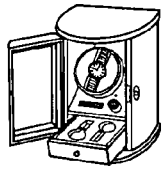
Figure 21P

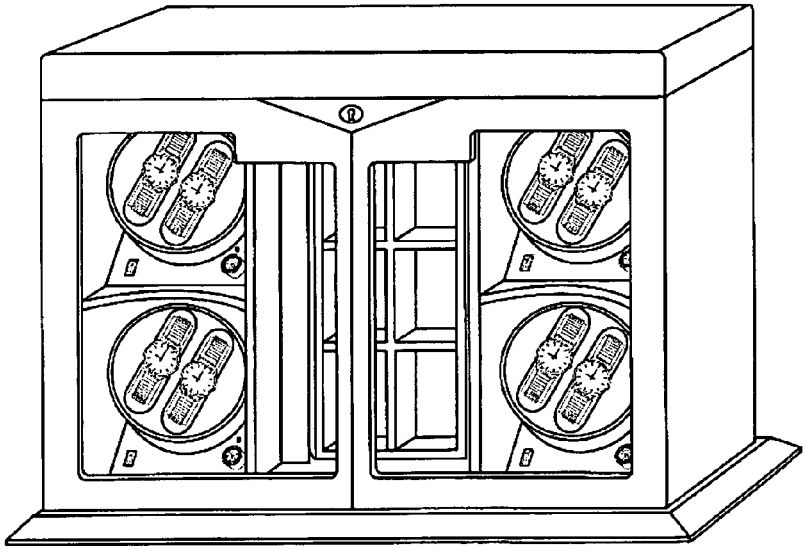
Figure 22 -A
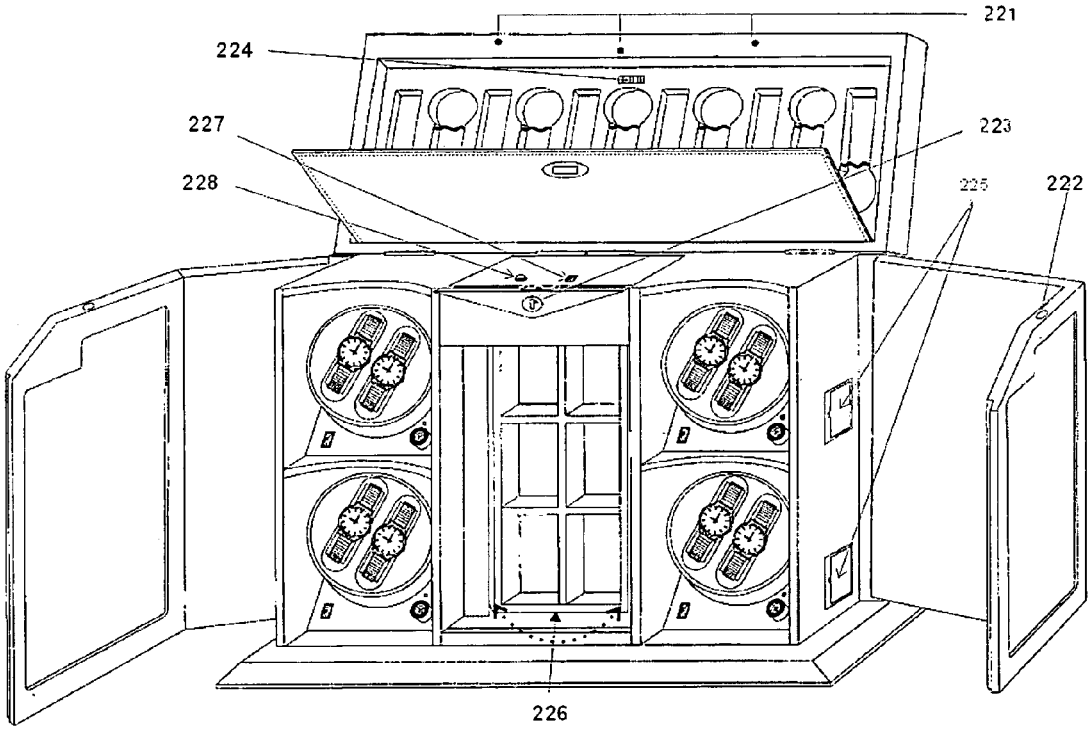
Figure 22 -B

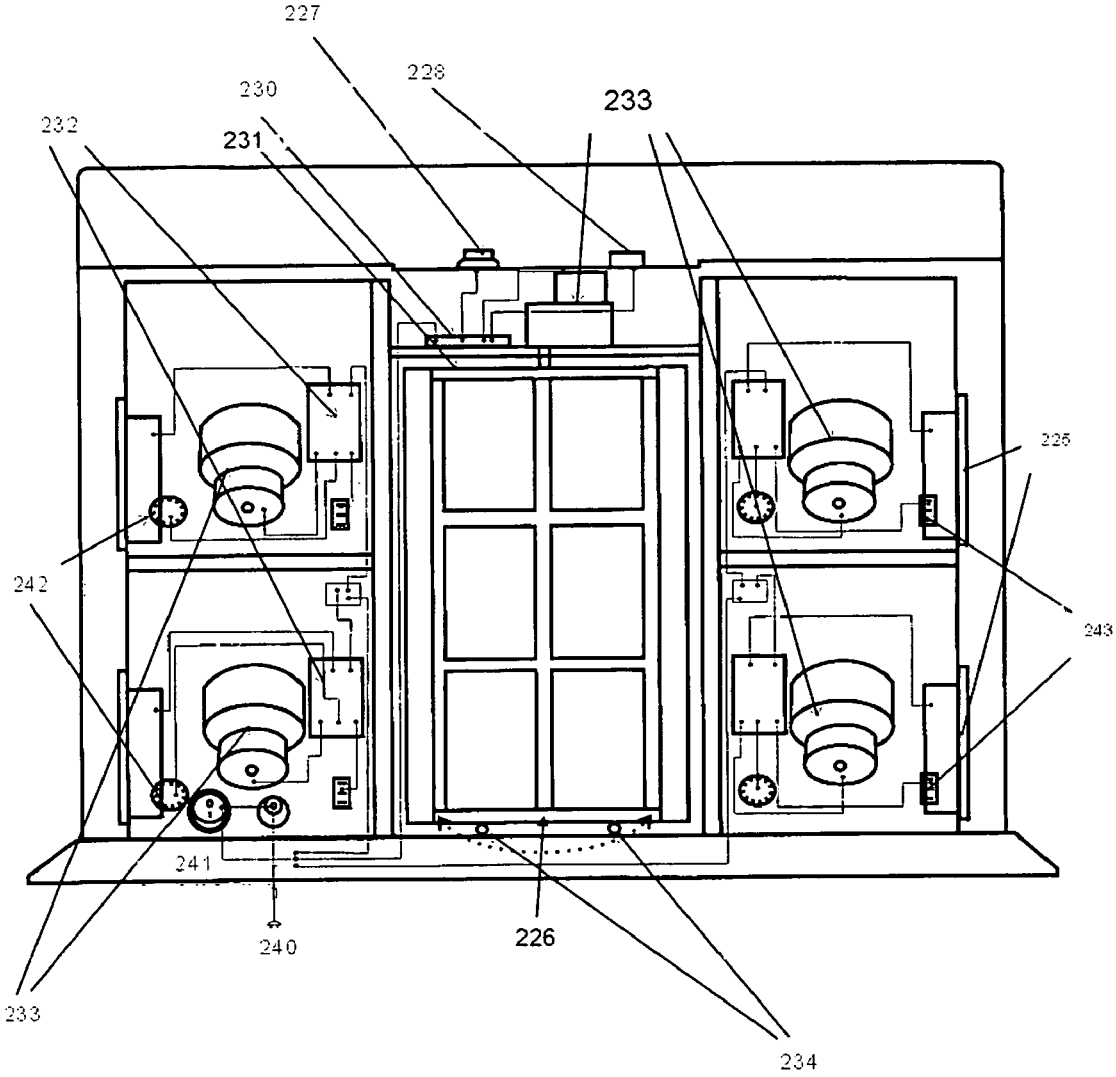
Figure 22 -C

WATCH-WINDING APPARATUS

CROSS-REFERENCE TO RELATED APPLICATION

This application is a continuation-in-part of U.S. patent application Ser. No. 11/326,786 filed Jan. 6, 2006.

FIELD OF THE INVENTION

This invention relates to a watch-winding apparatus, particularly to the improvement of an automatic watch-winding apparatus.

BACKGROUND OF THE INVENTION

Automatic watch-winding apparatus have been developed for decades. Therefore, there are many different kinds of automatic watch-winding apparatus for self-winding watches in the market nowadays. An advanced prior art of this kind is disclosed in U.S. application Ser. No. 10/895,528 filed Jul. 21, 2004 which was invented by the same inventor of this invention.

The prior art generally still may have one or more of the following deficiencies:

1. Since the indicating system is too simple, the user can not know what program and in what status the automatic watch-winding is now operating.
2. Since the watch is placed and revolved in a form not perfectly simulating a human wrist, the most part of input energy as well as the time are not most efficient.
3. Since there is no handle or any tab on the cushion holder, the cushion holder is difficult to be pulled out.
4. Since the whole apparatus is portable, the drawer automatically slides open when the apparatus is being handled from one place to another, which might cause things in the drawer to fall out.
5. Since heavy watches may be placed on the winding cup, the slipping device may cause the cup to slip.

Therefore, the prior art apparatus should be improved to address the noted deficiencies.

SUMMARY OF THE INVENTION

An object of this invention is to provide an automatic watch-winding apparatus which addresses one or more of the above mentioned deficiencies. One or more improvements for certain embodiments are as follows:

1. An electronic LCD screen is now adopted for helping the user select programs as he turns the knob; and then showing the present status when he release the turning action for 5 seconds.
2. A new swing action is now adopted which more closely simulates wrist movement.
3. A tab is now added to the spring cushion for easy removal of the cushion.
4. A catch lock mechanism is now added inside the drawer to lock the drawer in its closed position. If the closed drawer is pushed again, the catch lock will be in its open status so that the drawer can be opened.
5. The slip clutch is now deleted to prevent a heavy watch causing the winding cup to slip. A direct drive system is now adopted.

The watch-winding apparatus in one form comprises: a bottom support; a body; a lid cover with a glass window; a plurality of tabbed spring cushions; a solid direct drive system for driving the rotating tray; and an electronic system for managing the rotating tray swing in accordance with the intended program. If equipped with a drawer, a catch lock mechanism is also provided to prevent the drawer from automatically sliding open.

In another embodiment, a watch-winding apparatus comprises a body. The frame is mounted to the body and is pivotal about a first axis. A tray is mounted to the frame and is pivotal relative to the frame. A motor has a drive axis. A drive connector assembly connects the tray and is driven by the motor so that the tray moves in a circular wobbling movement relative to the drive axis.

The connector assembly comprises a rod fixed to a central underside of the tray and the motor connects with a second connector at a location offset from the drive axis. The frame is a gimbal frame mounted to the body by a pair of axially spaced pins. The tray has an axle having opposed end portions received in openings of the frame. The tray receives a spring cushion for a watch.

BRIEF DESCRIPTION OF THE DRAWINGS

FIGS. 1A and 1B are each perspective views of a prior art watch-winder.

FIG. 2 is a perspective view of a watch winder of the present invention with a normal analog function rotator dial in a closed status.

FIG. 3 is a perspective view of a watch-winder of this invention with a LCD screen and a function rotator dial, in operating status.

FIG. 8-1 is a part-list for FIGS. 8A and 8B.

FIG. 8-2 is a part list for FIGS. 8C-8E.

FIG. 9-1 is a multi-schematic perspective drawing of a gyro-winder.

FIG. 9-2 is a schematic cross section of the side (Sagittal) plane of the gyro-winder of FIG. 9-1 with enlarged portions being illustrated in enlarged views.

FIG. 9-3 is a schematic view of the main body of the gyro-winder of FIG. 9-1 from the front.

FIGS. 10-1 and 10-2 are drawings for explaining two optional selector dial designs.

FIGS. 11-1 and 11-2 are drawings for explaining another two optional selector dial designs.

FIGS. 12-1 and 12-2 are drawings for explaining further two optional selector dial designs.

FIG. 15 is an explanatory table for FIG. 13 and FIG. 14.

FIG. 18 is an explanatory table for FIG. 16 and FIG. 17.

FIGS. 19A and 19B are perspective views of an optional simplified design of a watch-winder.

FIGS. 20A and 20B are perspective views of another optional simplified design of a watch-winder.

FIGS. 20-1A and 20-1B are perspective views of another optional simplified design of a watch-winder.

FIGS. 21A through 21P are perspective views of further optional simplified designs of a watch-winder.

FIG. 21-1 is a simplified cross section view, partly in schematic, of the series winder of FIG. 21A.

FIG. 22-A is a perspective view of an 8-watch winder with swivel center display, with the door closed.

FIG. 22-B is a perspective view of an 8-watch winder with swivel center display of FIG. 22-A, with the door opened.

FIG. 22-C is an interim cross section view of the 8-watch winder with center swivel display of FIG. 22-A.

DETAILED DESCRIPTION OF THE EMBODIMENTS

Figures 9A, 9B:
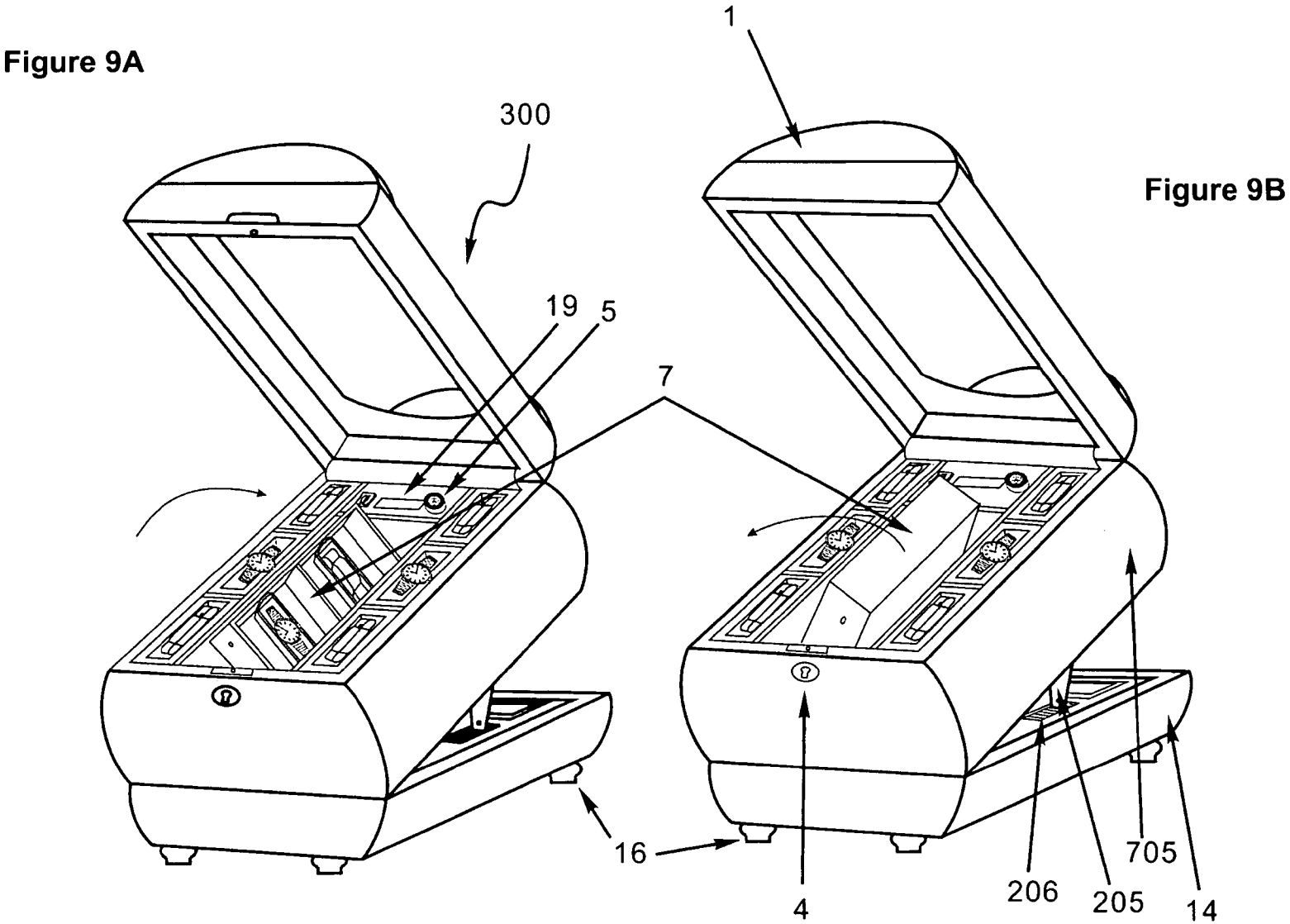
FIGS. 9A and 9B are respectively a perspective drawing for showing how the watch is swung in right and left within limited tilting angle, in an open position.
Figure 9C:
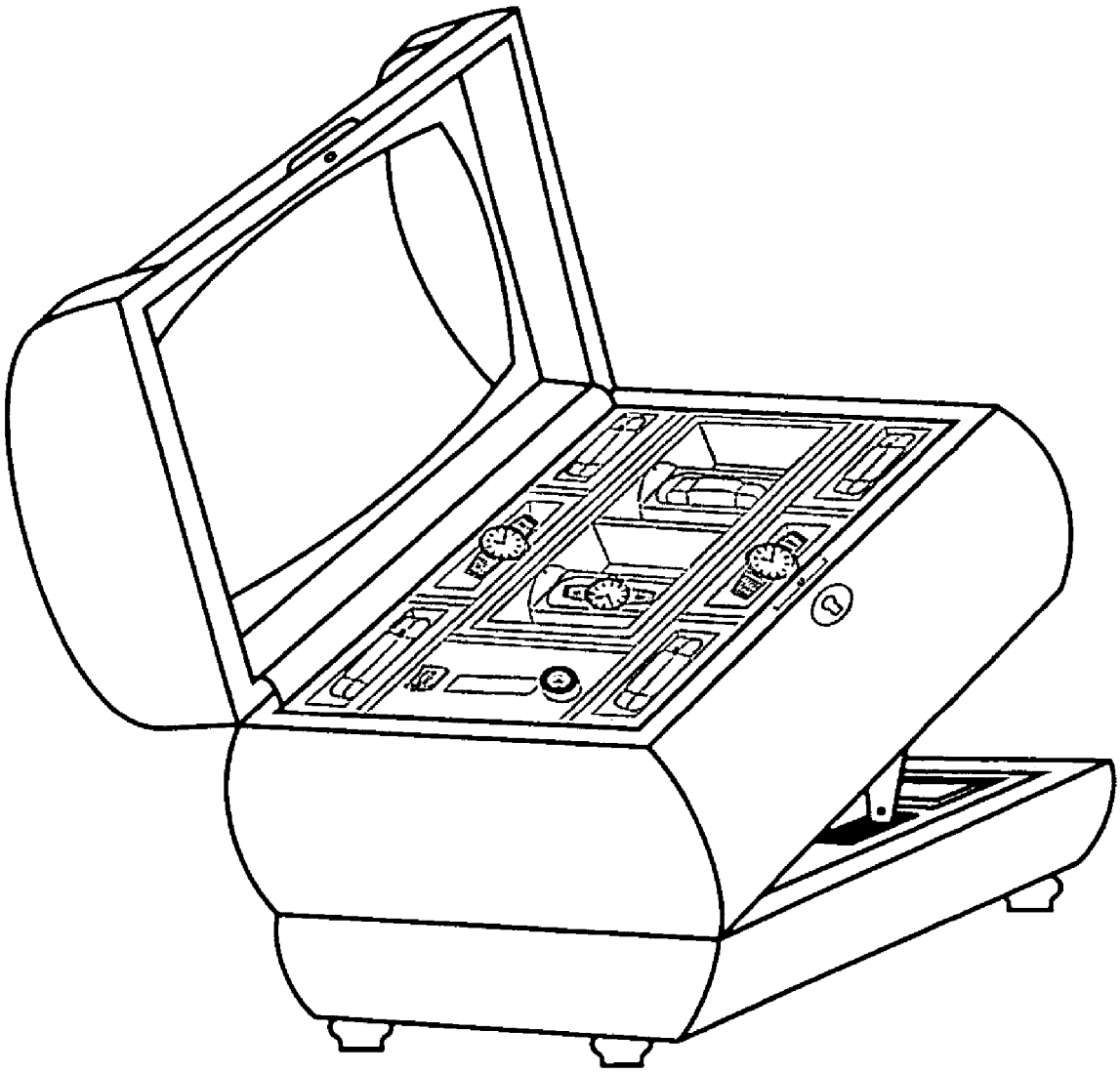
FIG. 9C is a perspective view of an alternative design of the gyro winder with a hinge built on the left side of the box.
Figures 1, 9:
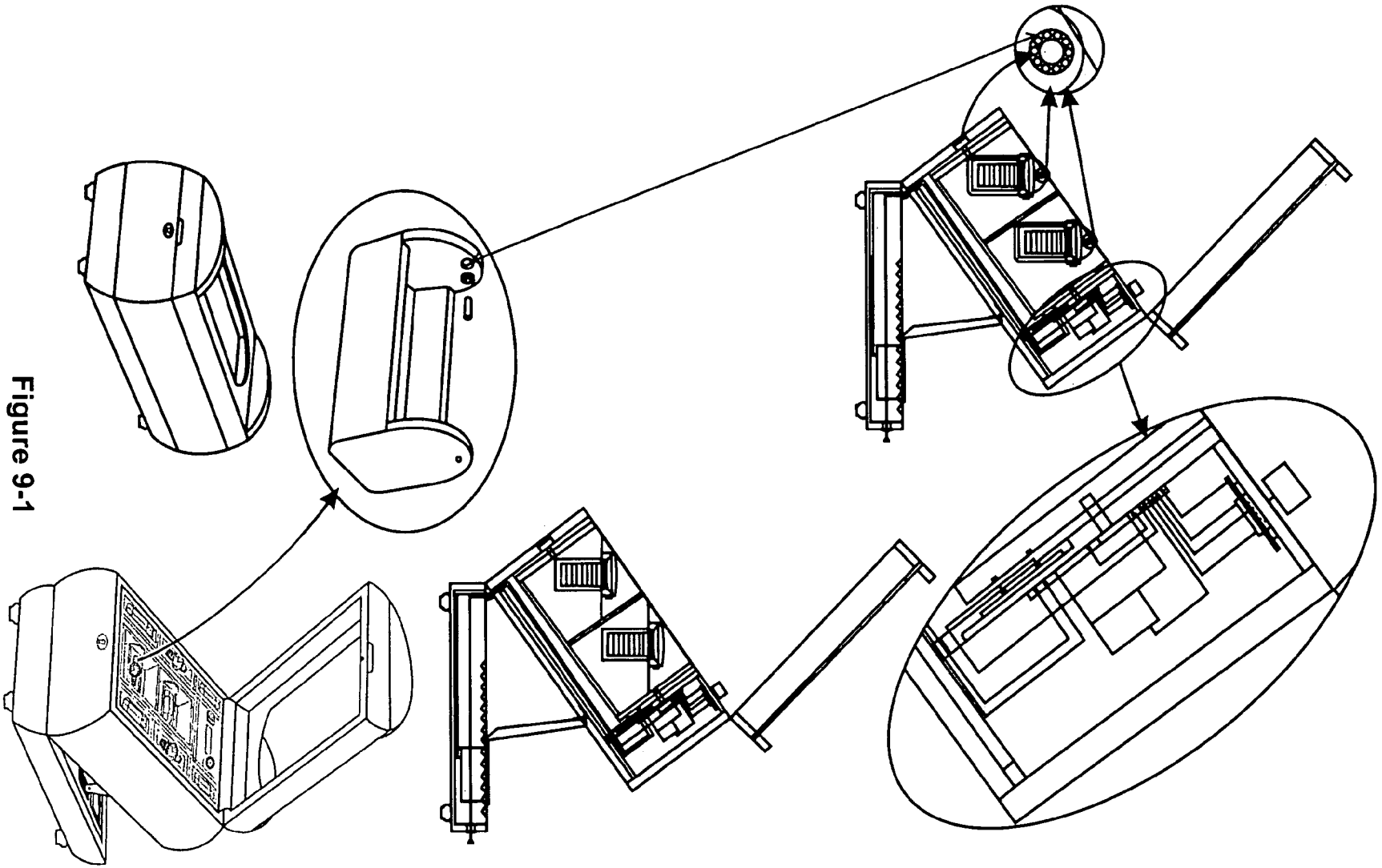

With reference to FIG. 1, there are two prior art watch-winders 100 and 200 disclosed in U.S. application Ser. No. 10/895,528 filed Jul. 21, 2004. Watch-winder 100 only has a knob 5 and an LED 11 for selecting the program. When the knob 5 is turned some angle, and a symbol on the knob 5 is just under the LED 11, the program (represented by said symbol) is selected. Though watch-winder 200 has a LCD panel 19 and two push-buttons 20, they perform the same function of the knob 5 and the LED 11 of 100.

Figures 2, 9:
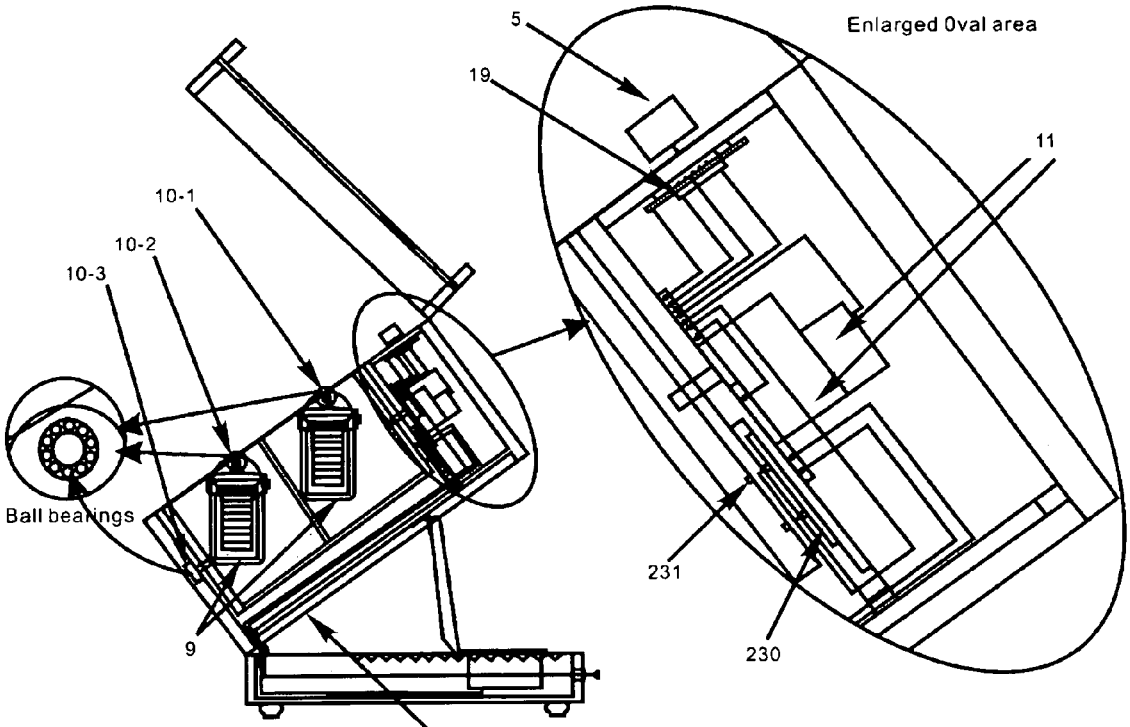
Figures 3, 9:
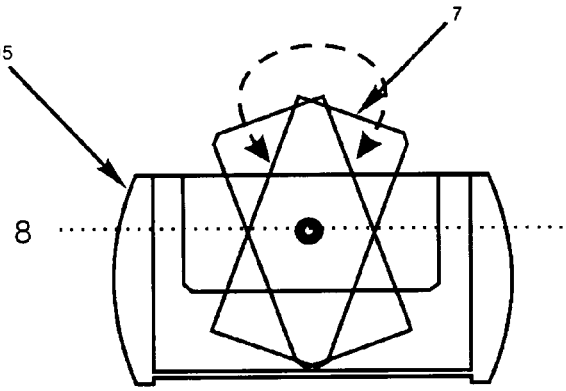

With reference to FIGS. 2 and 3, a perspective view of a new designed watch winder is shown with a normal analog function rotator dial in a closed status. FIG. 3 is a perspective view of the watch-winder with a LCD screen and a function rotator dial, in an operating status. In both FIG. 2 and FIG. 3, watch-winder 300 has a lid 1, a plurality of the self-adjustable watch cushion holders 2, a glass window 3, a lock 4, a knob 5 for selecting program, two rotating trays 7 for winding the watch (its action will be described in detail later), a body 705, a bottom support 14, a plurality of the rubber legs 16, a on/off switch 17, and a LCD panel 19.

Figures 3A, 3B:
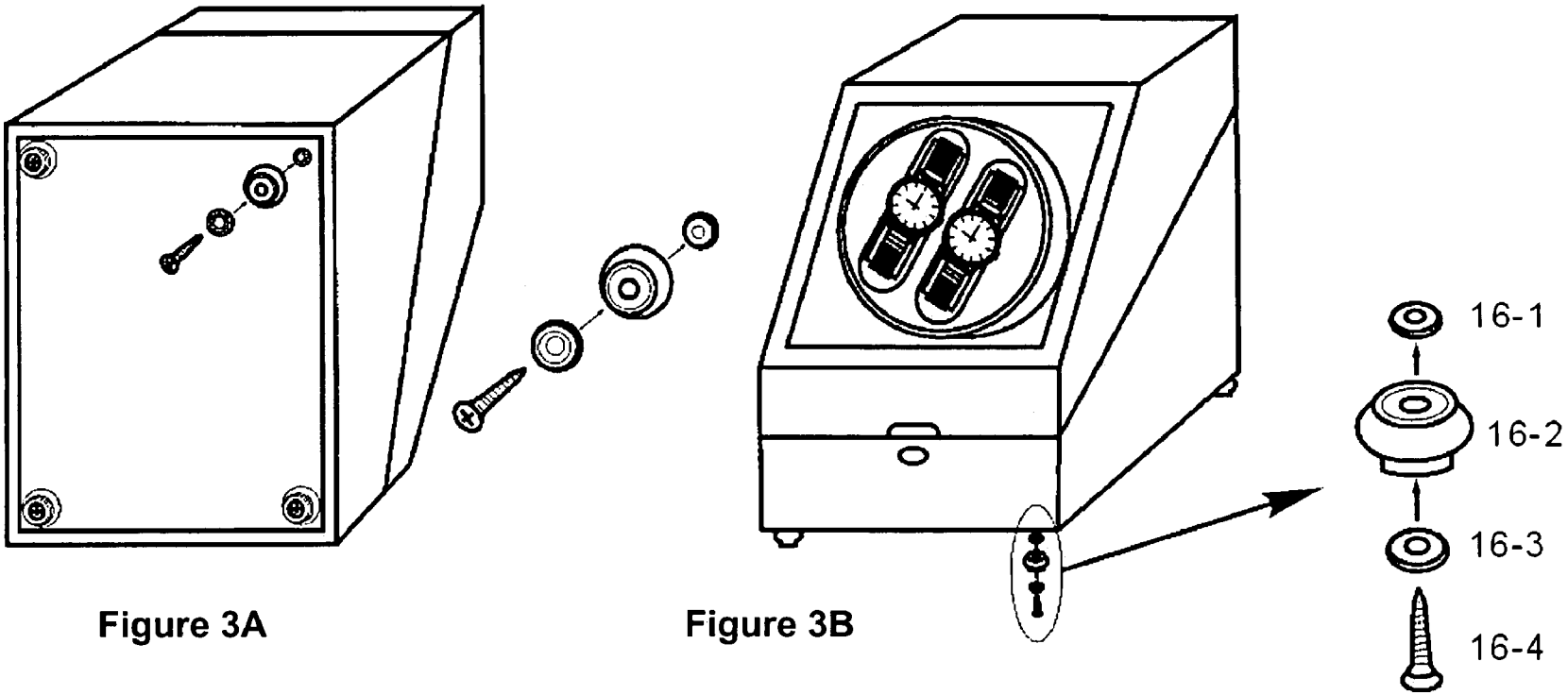
FIGS. 3A and 3B are each an exploded perspective view for showing the leg assembly.

FIGS. 3A and 3B are explosive perspective views for showing the leg assembly. The leg 16 is now improved visually and functionally. The main body 16-2 is now made of metal with polished glossy finish to give a shiny look. Rubber rings 16-1 and 16-3 are to act as shock absorbent and scratch-resistant devices. Screw 16-4 mounts the whole set into the bottom 14 of the winder unit 300 or 400.

Figure 4:
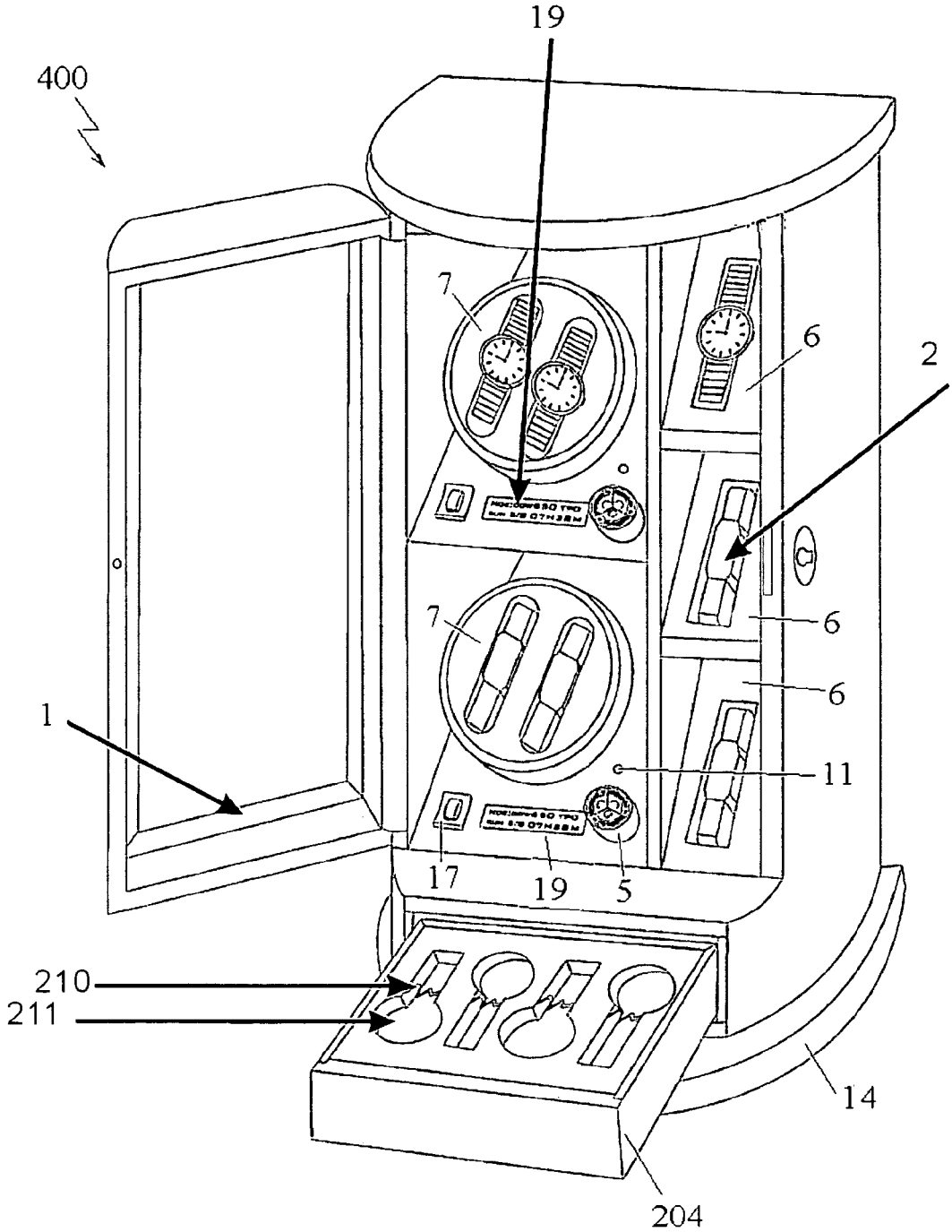
FIG. 4 is a perspective view for preferred embodiment of the watch-winder with a LCD screen and a function rotator dial, in an operating status.

In FIG. 4, the watch-winder 400 has a body 705 perpendicular to the ground. Two rotating trays 7, one above the other, each has pre-fixed inclination which is unadjustable. Each has its own selecting knob 5, LED 11, on/off switch 17 and LCD panel 19. In FIG. 4, there are 3 frames 6 for receiving extra watches and spring cushions 2. Drawer 204 is equipped on the bottom of the winder 400. Since in FIG. 4 the drawer 204 is opened, a plurality of watch storage hollows 211 each having an elastic stopper 210 can be seen. Bottom support 14 is now in the form of a base.

Figure 5:
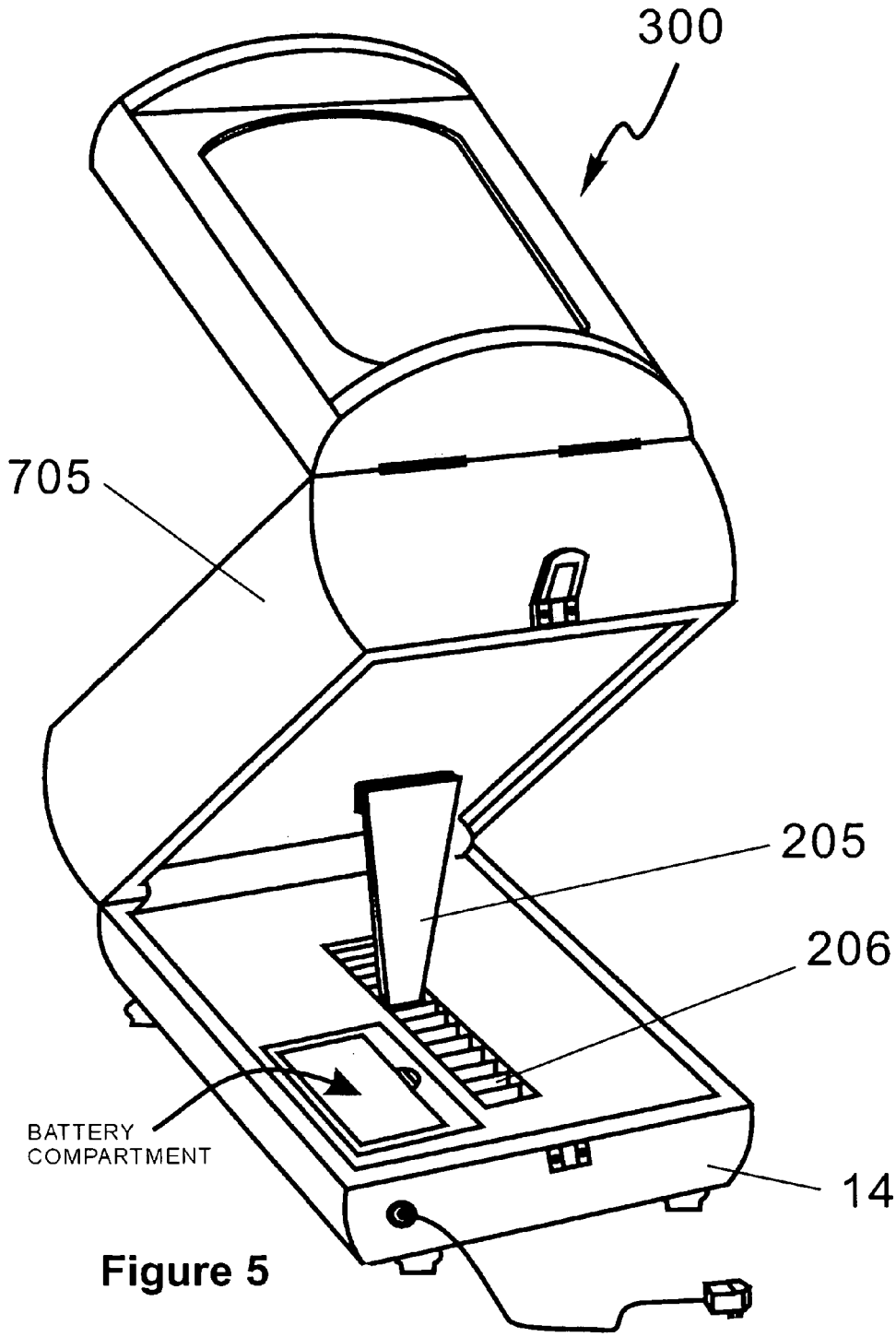
FIG. 5 is a perspective expanded back view of the watch-winder of FIG. 3.

In FIG. 4, the inclination of the watch to be wound is unchangeable. While in FIG. 3, the inclination of the watch to be wound is adjustable. FIG. 5 is a perspective back view of FIG. 3 for showing the inclination can be adjusted by the brace 205 onto a ratch 206. In this case, since the body 705 of the winder 300 can be opened from the bottom support 14, articles can be received in the space (not shown) made on the bottom support 14. The drawer 204 of FIG. 4 can be omitted.

Figures 6A, 6B:
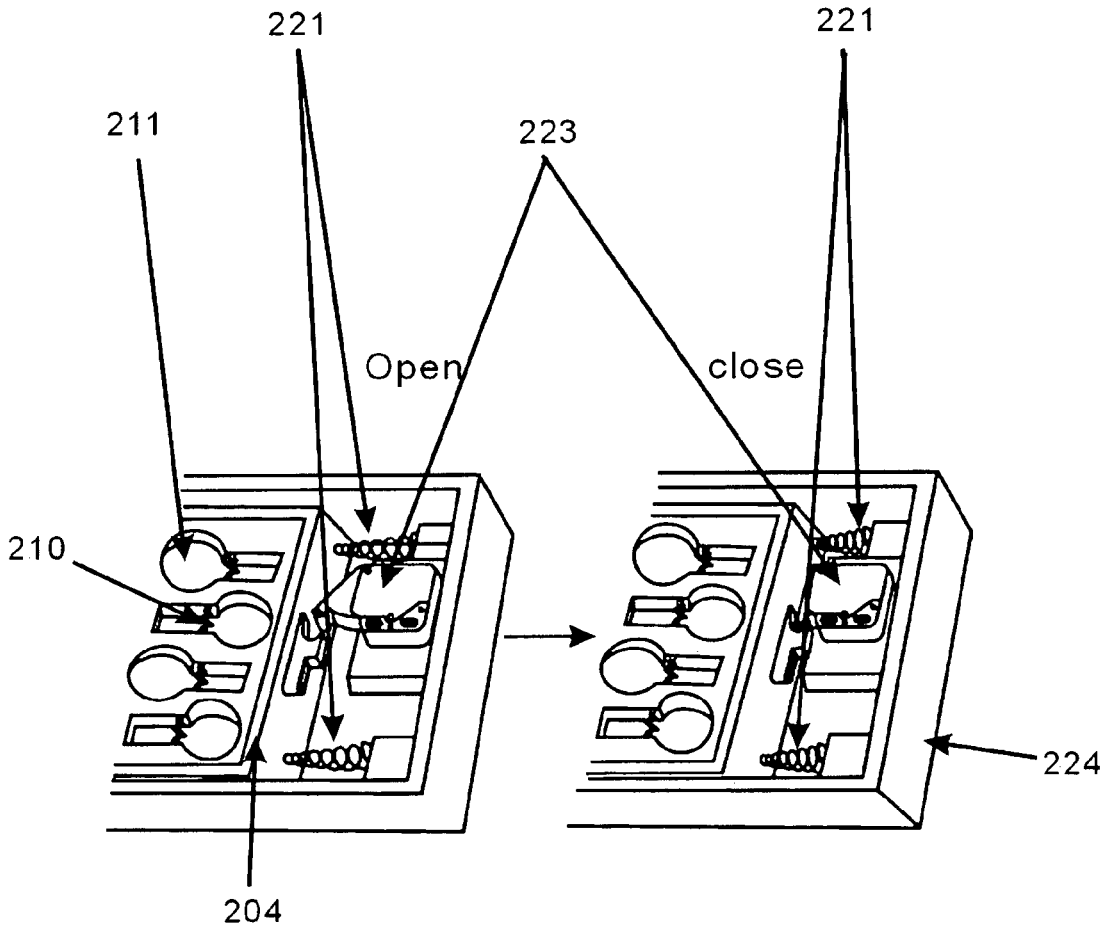
FIGS. 6A and 6B are respectively a perspective view of the push lock and push open mechanism of the drawer with a balancing coil spring construction.

FIG. 6 is a perspective view of the push lock and push open mechanism of the drawer with a balancing coil spring construction. In FIG. 6, 224 is the exterior housing of the winder 300. When the drawer 204 is in a closed position, the catch lock 223 is in a closed lock position. If drawer 204 is being pushed again, this push force will disengage the catch lock 223. The catch lock 223 will then be in an open position. There are two pieces of coil spring 221 positioned on the back of the right and left shoulder of the drawer 204. These coil springs 221 will give a pushing force outward when the drawer 204 is in an open position. Therefore, the drawer 204 will be forced outward so that a person can remove the drawer 204 easier. In addition, the 2 coil springs 221 help to balance the drawer weight and the front of the drawer 204 could flush to the front wall of the winder 300. The elastic stopper 210 allows the watch be inserted into the hollow 211 flexibly and at the same time stop it from falling off the hollow easily.

Figure 7A:
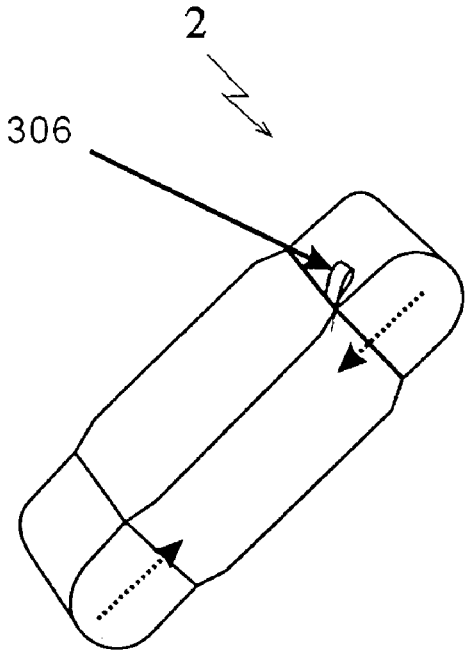
FIGS. 7A and 7B are respectively a perspective and an interior exploded view of the coil spring cushion with handle.
Figure 7B:
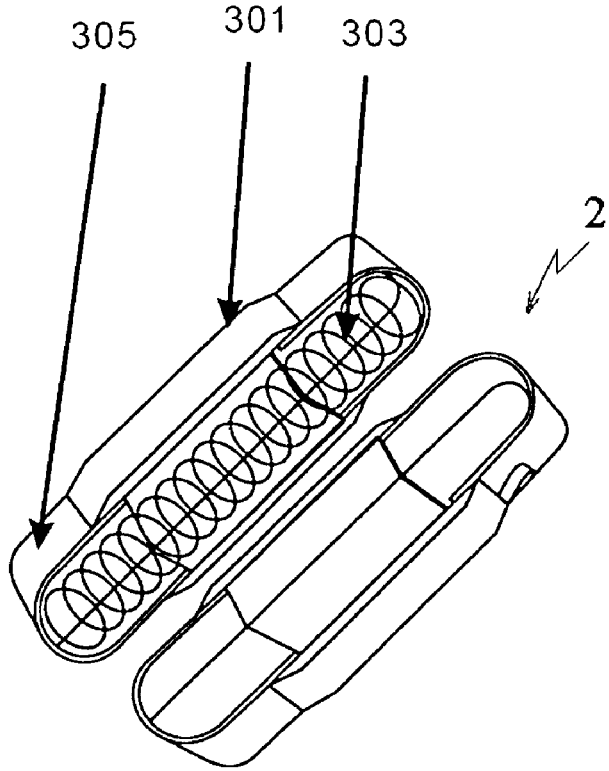

FIGS. 7A and 7B are perspective and interior exploded views of the coil spring cushion with a handle. The self-adjustable watch cushion holders 2 comprise two side soft cushioning 301 for producing more friction, a coil spring 303 pushes the adjustable slider 305 outwardly for abutting its matched concave end, and a handle 306 in the form of a tab is now attached on the end of said soft cushions 301 away from said adjustable slider 305. This is an improvement of the prior art cushion holder disclosed in U.S. application Ser. No. 10/895,528. It will be easier to remove the spring cushion 2 from the cushion hollow holder.

Figures 8A, 8B:
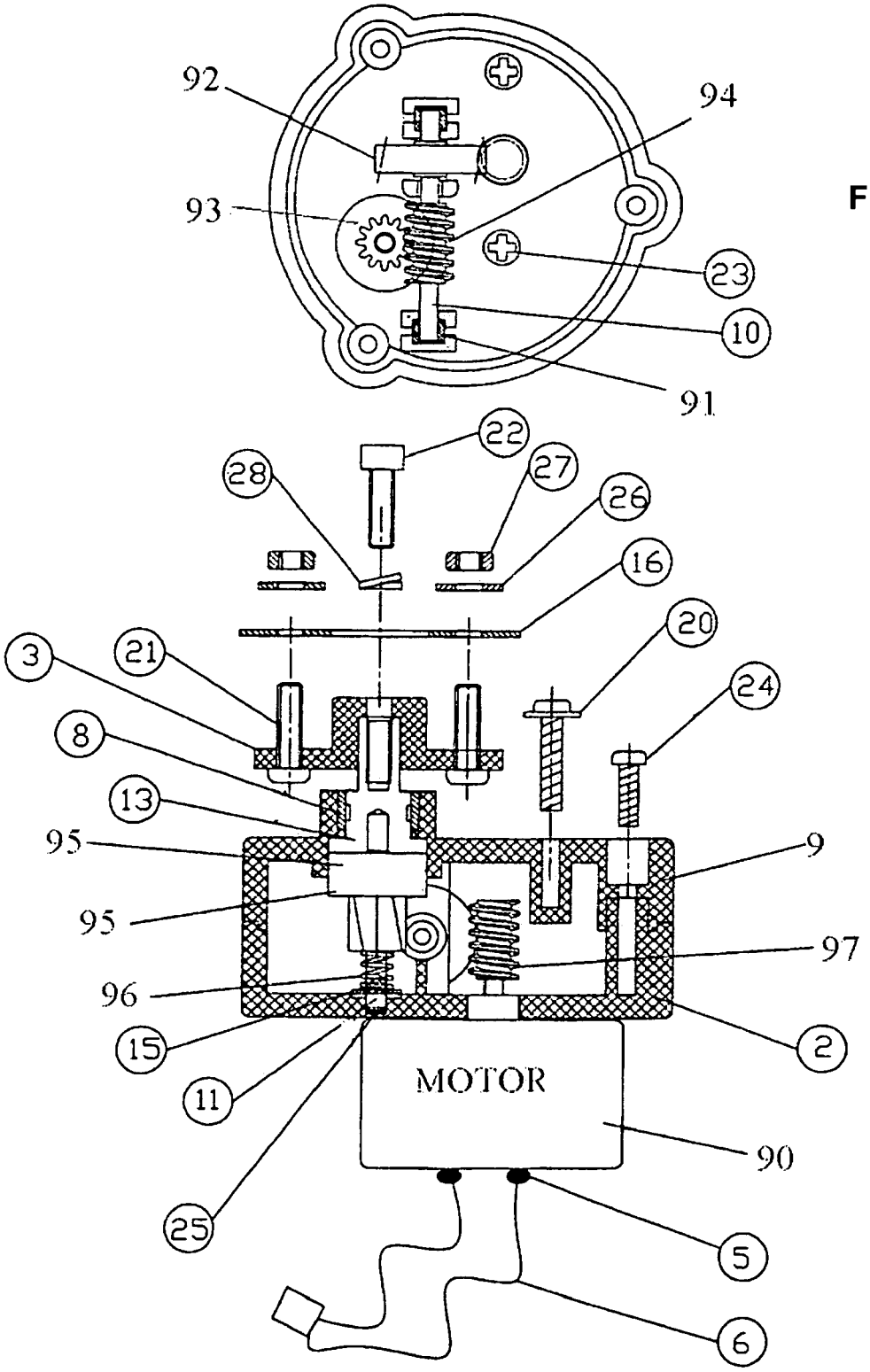
FIGS. 8A and 8B are respectively a cross section horizontal and vertical view of a gear box with direct drive system for the watch-winder of FIG. 3.

FIGS. 8A and 8B are cross section horizontal and vertical view of the gear box with direct drive system. In fact, FIG. 8 is very similar to FIG. 4 of U.S. application Ser. No. 10/895,528 except gear 95 in U.S. application Ser. No. 10/895,528 is a slip clutch while in this embodiment, it is a solid part. Thus, when this part transfers torsion between the driving source and the driven load, no slippage will take place. FIG. 8-1 is a part list for FIGS. 8A and 8B.

Figure 8C:
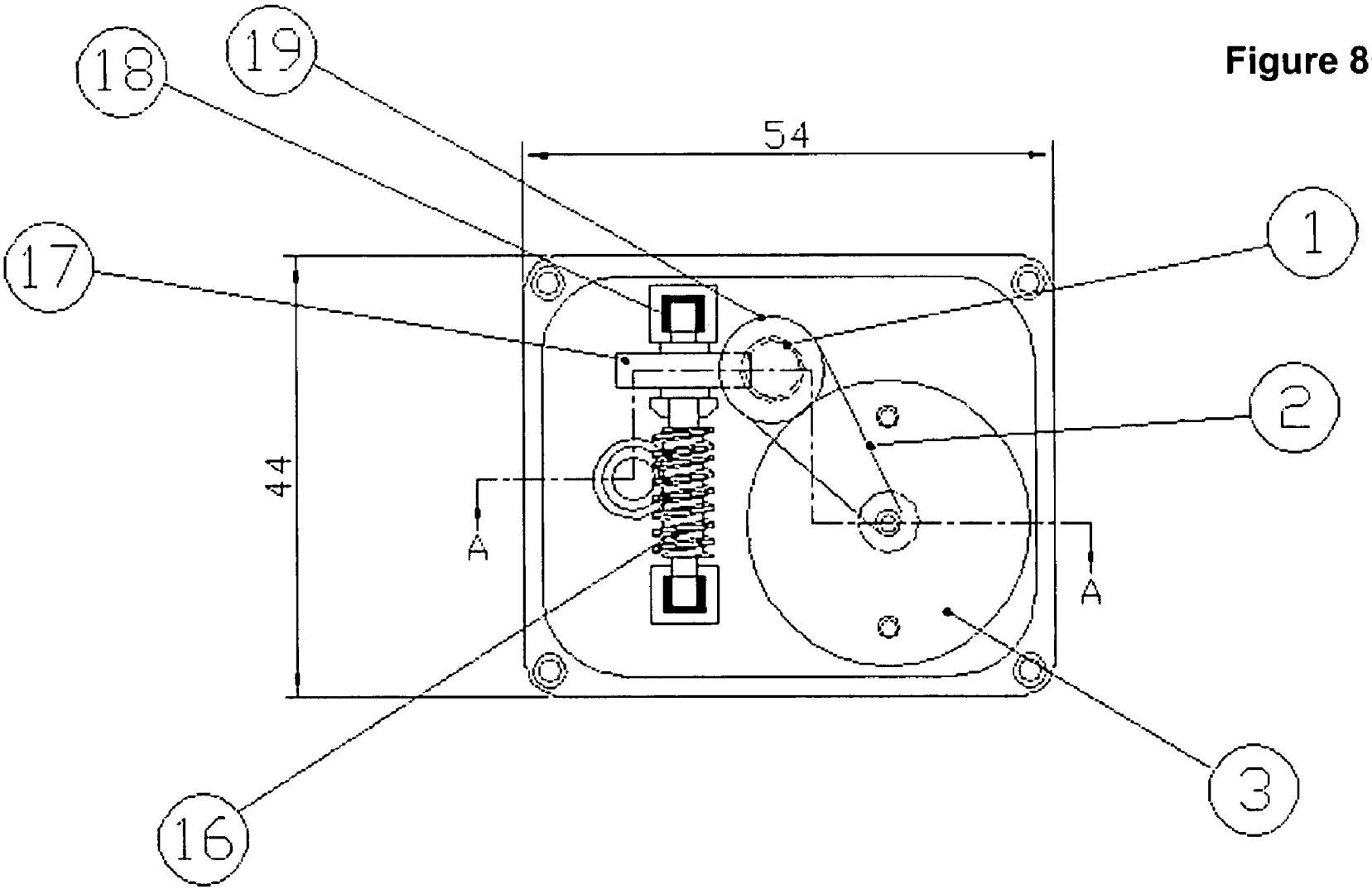
FIG. 8C is a top view of the gear box with timing belt system.
Figure 8D:
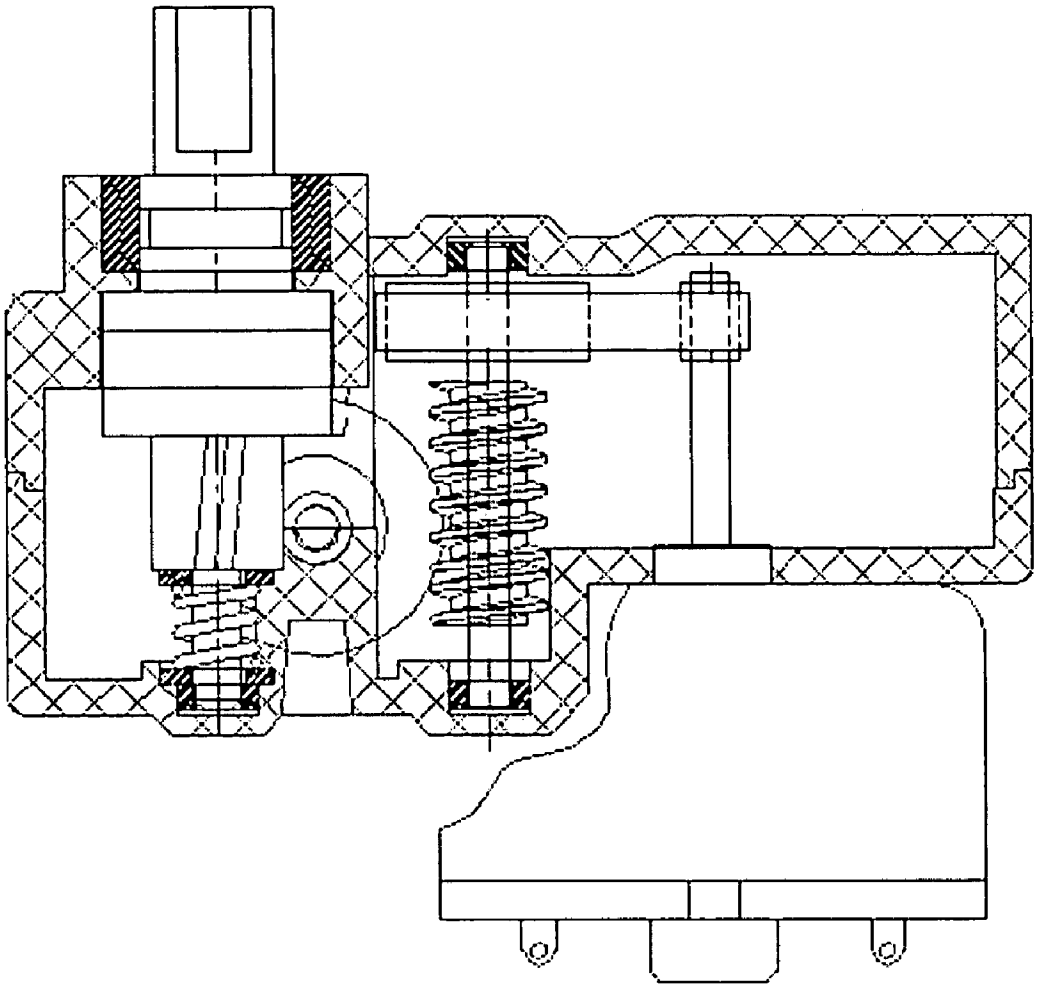
FIG. 8D is a cross section assembled view along the A-A line of the gear box with timing belt system.
Figure 8E:
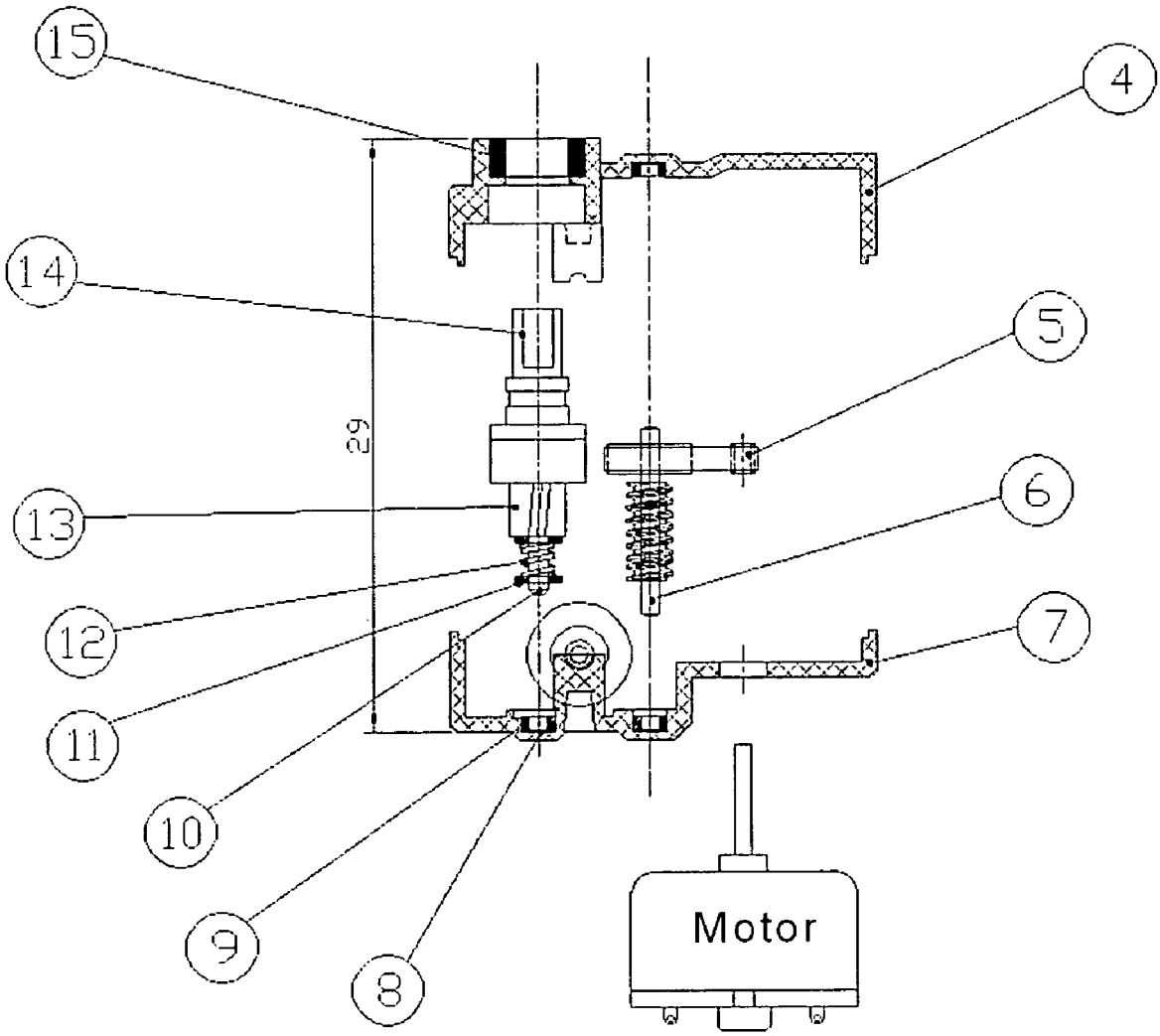
FIG. 8E is a cross section disassembled view along the A-A line of the gear box with timing belt system.

FIGS. 8C, 8D and 8E are cross section horizontal and vertical views of the gear box with direct drive with an additional timing belt system. This an alternative design of the gear box as described under FIGS. 8A and 8B. The timing belt separates the input shaft from the output shaft. Therefore any vibration from the input motor could be significantly reduced when the power is transferred to the output shaft with the timing belt functioning as a shock absorbing buffer. A more stable and a quieter output shaft will enable the watch holder bowl to rotate in a more stable and a quieter mode. FIG. 8-2 is a part-list for FIGS. 8C-8E.

FIGS. 9A and 9B are perspective drawings for showing how the watch is swung in right and left within a limited tilting angle, in the open position. In FIG. 9, the rotating tray 7 is driven by the direct drive system of FIG. 8 to (not shown in this FIG. 9) perform a swing action. Tray 7 can be swung from right to left and then, from left to right within 170 degrees, thus simulating a wrist movement. The inclination angle adjuster, brace 205, while moving to front and back of ratch like position marker 206 will tilt the main body 705 to different angles as required. The orientation of the watch case is therefore changed according to the tilting angle of the main body 705. The main purpose is to allow the watch to face at an inclination angle away from horizontal to allow the winding disc inside the watch case to move due to gravity force. The swing tray 7 while swinging will therefore allow the watch winding disc to swing generating energy for the watch. As the torque and sluggishness of the moving disc of each movement could be different, this flexible angle adjustment allows the user to make tilting angle most suitable for their particular brand or type of watch movements. In addition, while the winder 300 is in all open positions, it displays a very unique "Z" shaped figure. Upon placement in the display window of a shop, this unit is a very eye-catching design. Coupled with its swinging action, user selectable function, full LCD display, extra watch holding trays, the whole unit becomes very distinguishable by itself.

FIG. 9C is a perspective view of an alternative design of the gyro winder with a hinge built on the left side of the box.

FIG. 9-1 shows a perspective drawing of the gyro-winder. FIG. 9-2 shows the cross section of the side (Sagittal) plane of the gyro-winder. FIG. 9-3 shows the cross section of the frontal plane. Description of kinetic movement of the gyro-winder is described as follows: this winder employs a dual-motion concept. A) The main body 705 is slanted by adjusting the supporting leg 205 against the teeth rail 206. The outer body 7 rotates on a left-right motion with the axis 8 on a north-south plane. The rotation is driven by the motor 11. The ball bearing 10-3 serves as a supportive leverage against the rotating body 7. B) The inner body 9 has a cavity where a watch cushion 2 is inserted. A watch wraps around the watch cushion 2. Two ball bearings 10-1, 10-2 are located on each side of the inner body 9 against the walls of main body 7. The inner body 9 therefore always tends to align vertically downwards due to gravity pull. The axis of movement is along the ball bearing 10-1, 10-2 plane. C) While the outer body 7 rotates transversely, it will change direction. Upon reaching its maximum angle (or when the magnet built into the wall of the outer body 7 aligns to the magnet sensor of the PCB located next to the motor) the computer chip will give a command to the motor to change direction. This change of direction will cause a "toss" effect to the inner body 9. This will result in a slip or swing of the inner body 9 causing a change of direction of the winding disk in the automatic watch movement of the watch. This disk movement will engage the winding of the coil spring of the watch movement. D) In addition, the winding disk movement is also engaged by the following movements: the watch face changes direction or angle of orientation while the outer body 7 is moving, as the inner body 9 changes the angles of tilting in variance to the movement of the outer body 7. Such movements engage the inner body 7 to various oblique tilting angles continuously adjusted to the movement of the outer body 9, due to gravity pull as per (B) above.

The variance of oblique tilt enables the winding disk of the watch movement to move either clockwise or counterclockwise, engaging the movement disk to a spring coil wind-up mode. The above 3-D or dual-direction movements simulates the combined rotation and flexion kinetic movement of a person's lower arm whereupon the left-right movement of the cup 7 simulates the twisting inward and outward of the lower arm; and the movement of the cup 9 simulates the flexion and extension of arm movement. Whenever there is a change of direction, the above kinetic movement would simulate a "toss" effect causing a minor vibration causing the winding disk to move from a north orientation to swing either clockwise or counterclockwise direction to a south orientation. The advantage of this dual 3-D motion mechanism compared to a circular motion is that it would generate more kinetic energy than a conventional circular movement. Less time is needed to wind up the watch than the traditional circular motion. Therefore, less power is needed to generate the same amount of winding session. In addition, such dual movement is more appealing to consumers while the product is on display in the store as it is quite different from the conventional circular motion of a watch winder.

In FIG. 9-1, the right-most section view shows that the cup 9 can be optionally fixed. In doing so, no gyro-function will take place.

Figure 23:
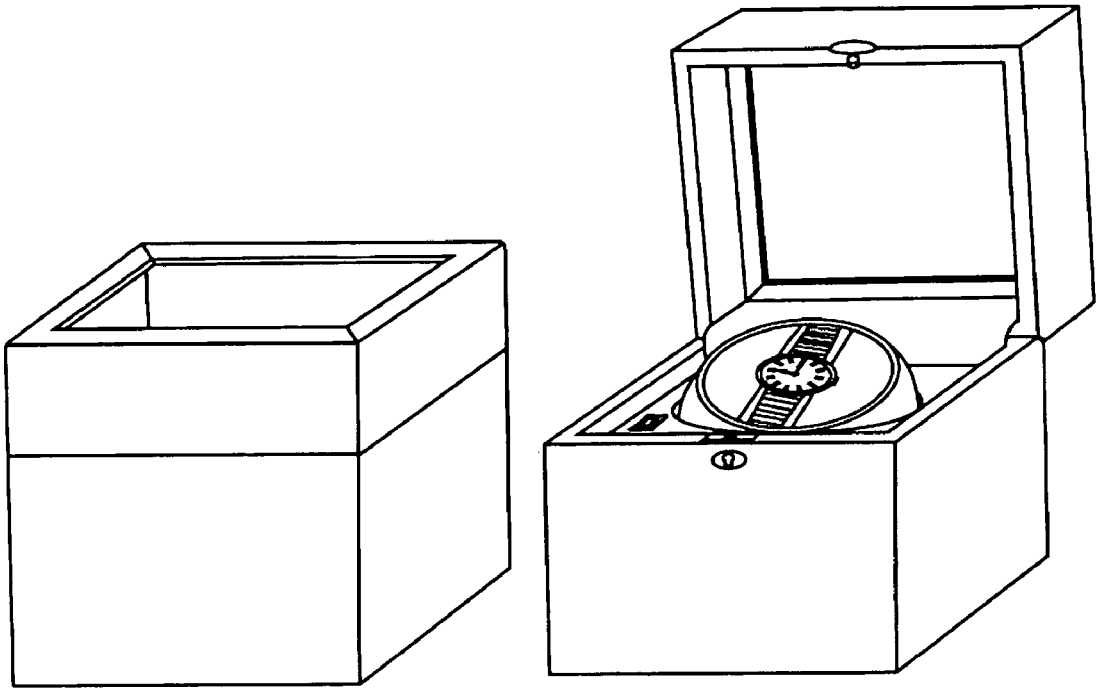
FIG. 23 is a perspective view of another embodiment of a watch-winder.
Figure 25:
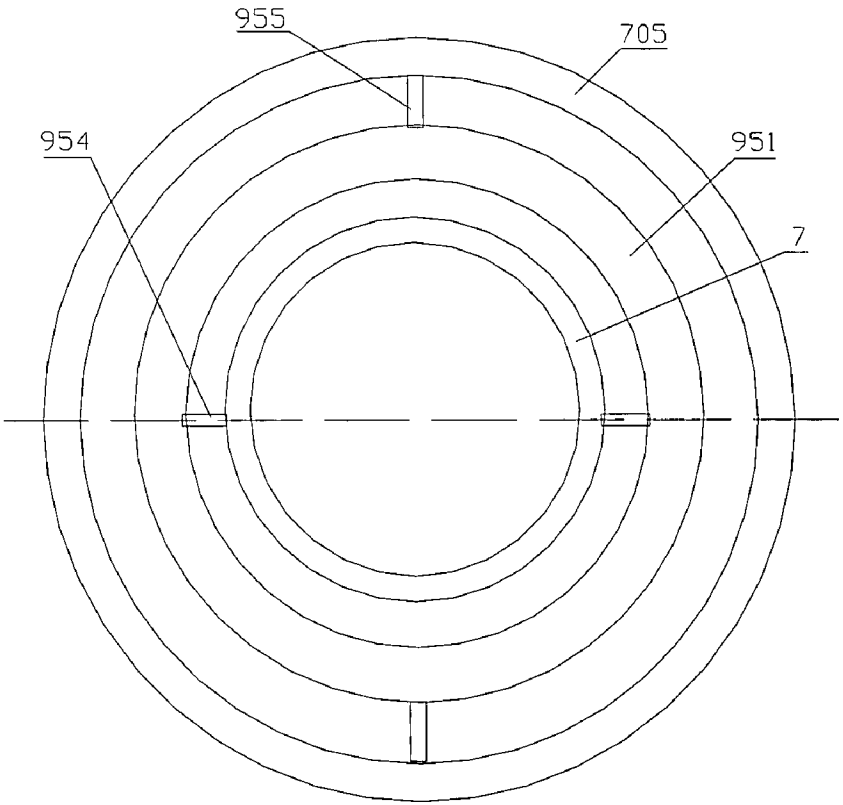
FIG. 25 is a view in the direction of A of the watch-winder of FIG. 24.
Figure 24:
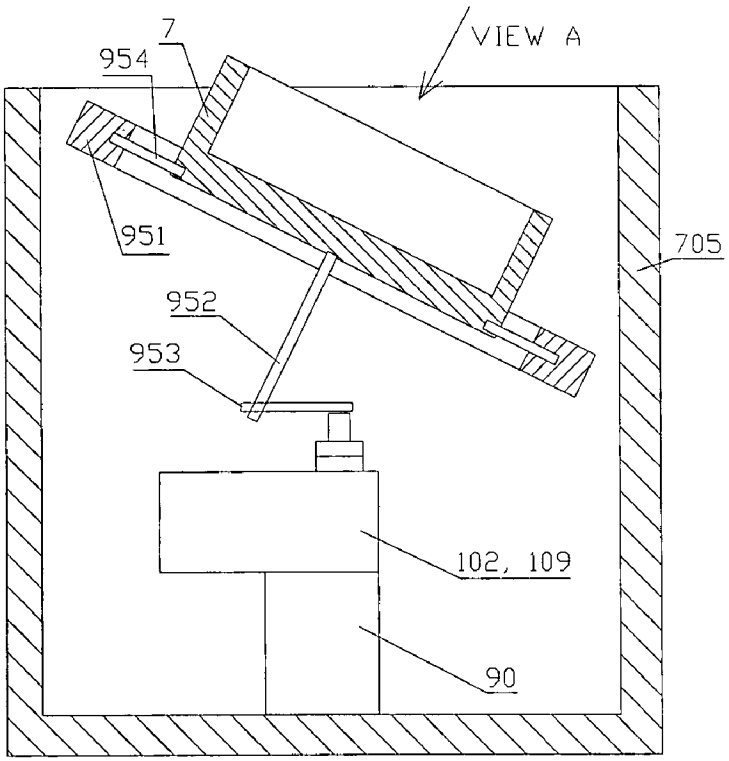
FIG. 24 is a sectional view, partly in schematic, of the embodiment of FIG. 23.

FIG. 23 is a perspective view for another improved embodiment of the embodiment shown in FIGS. 9-1 to 9-3. FIG. 24 is a sectional drawing for showing the inner construction of FIG. 23. In FIGS. 9-1 to 9-3, the wobbling of the wrist watch should be composed by both actions of inner body 9 and outer body 7, therefore, the construction is rather complex. While in FIGS. 23 to 26, this embodiment only needs a wobbling tray 7 to achieve the same winding job.

With reference to FIGS. 23-27, the watch-winder adopts a gimbal frame to replace the spherical bearing due to the limited space under the tray 7 of FIG. 24. In doing so, the so-called gimbal frame used in the ship for holding a compass is now adopted to replace the spherical bearing.

Figure 26:
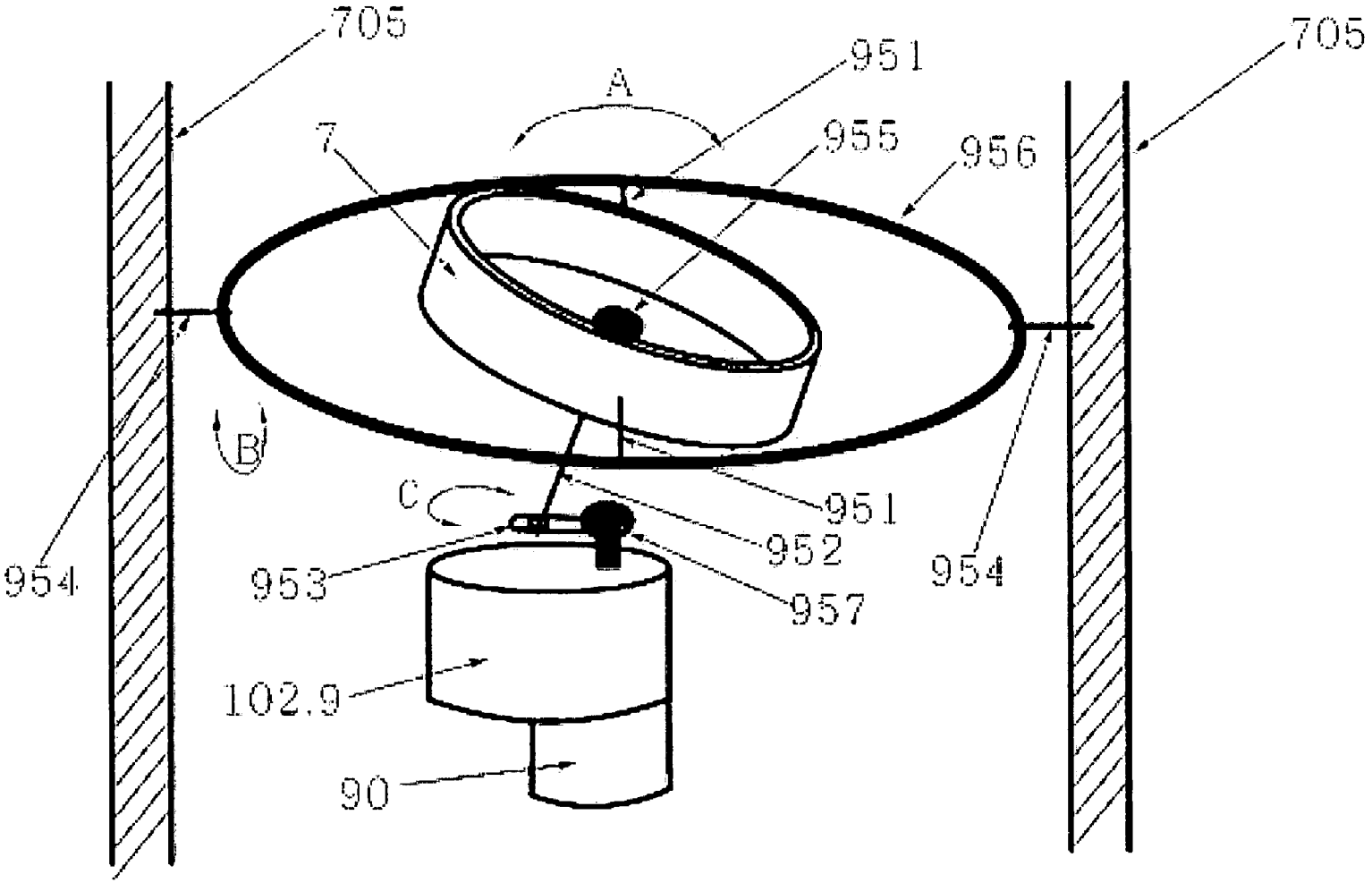
FIG. 26 is a schematic view illustrating the operation and movement of the watch-winder of FIG. 24.
Figure 27B:
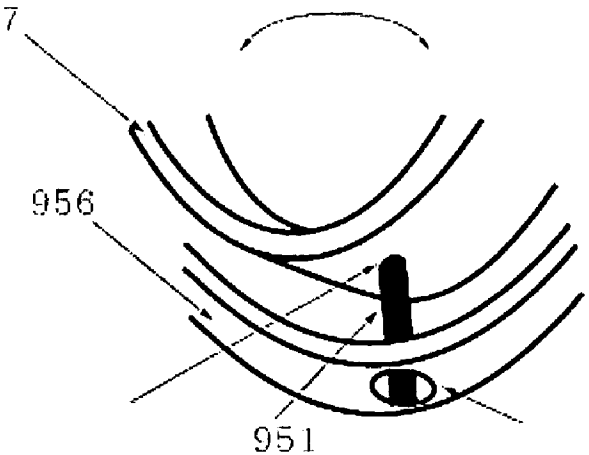
FIGS. 27A, 27B, 27C and 27D are enlarged fragmentary portions of the watch-winder view of FIG. 26.
Figure 27A:
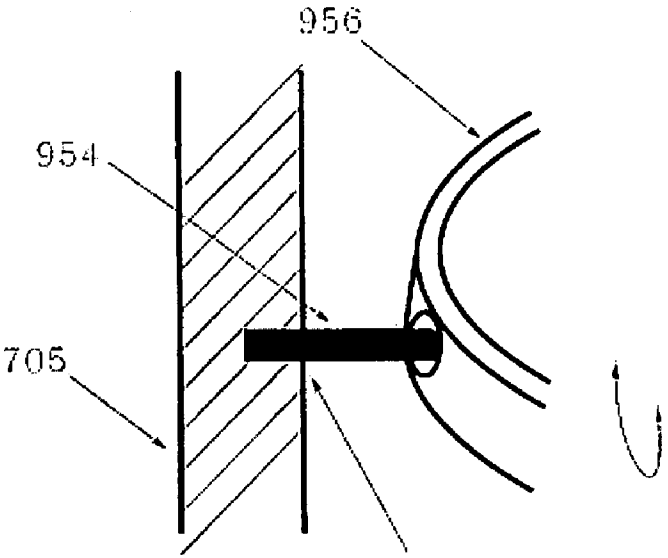
Figure 27D:
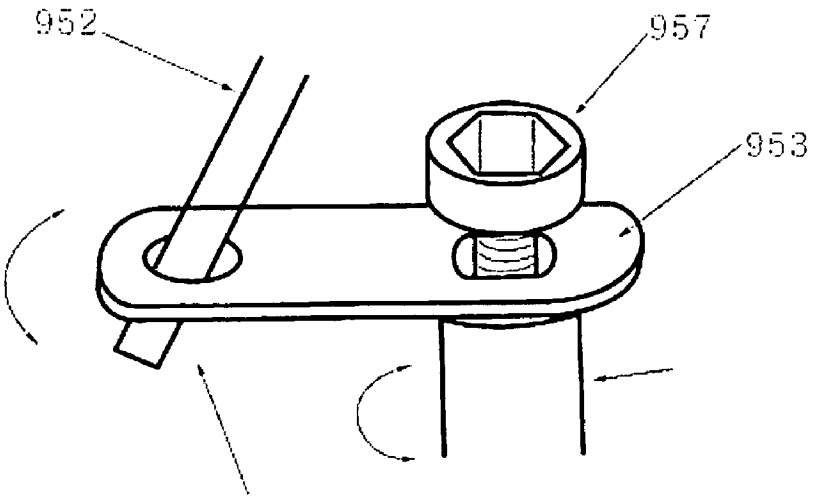
Figure 27C:
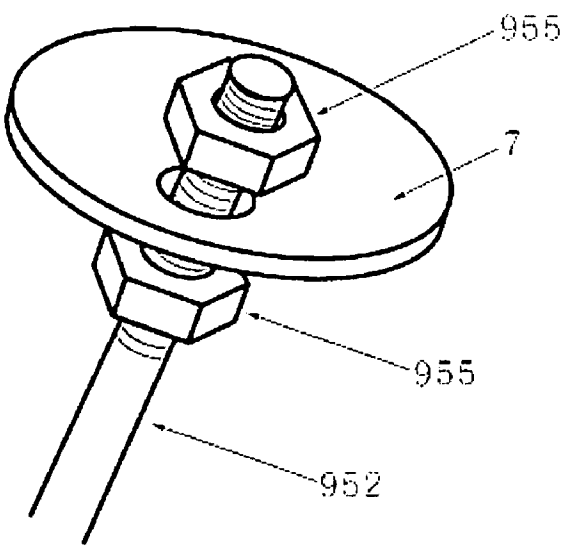

FIG. 24 is a sectional drawing for showing the principal components of this embodiment. In FIG. 24, a motor 90 is placed on the upper surface of the bottom of the body 705. In this drawing, the body 705 is cylindrical. However, in practice, this body 705 can be of various shapes other than cylindrical, such as an octahedron. The gear box 102, 109 are connected and placed on the said motor 90. The output shaft of the said gear box 102, 109 has a rod 953 which is used to push the lower end of the shaft 952 to revolve. As the tray 7 is now held by the gimbal frame and the shaft 952 is fixed to the center point of the tray 7, the said tray 7 is now wobbling in the said gimbal frame. The various motions are illustrated in FIG. 26. In FIG. 24, there is a ring 951, the pivot of which is connected to the said tray 7 by two pins 954. The said ring 951 is pivoted to the body 705 by two pins 955. The axes of the said two pairs of the pins are in the same plan and are perpendicular to each other. This layout can be clearly seen in View A of FIG. 25. Thus, the node of the said two axes acts as the center point of the spherical bearing. Additional details of the various connections are illustrated in FIGS. 27A-D.

Since the motor 90 is controlled by electronic circuitry, it can rotate clockwise, or anti-clockwise, or clockwise and anti-clockwise. Therefore, this embodiment can be used for watches which require different rotor directions. The 30 degrees inclination shown in FIG. 9-5 is preferred. Too small an inclination angle will cause difficulty in the rotor movement and too large an angle will detract from the appearance.

Figures 1, 2, 10:
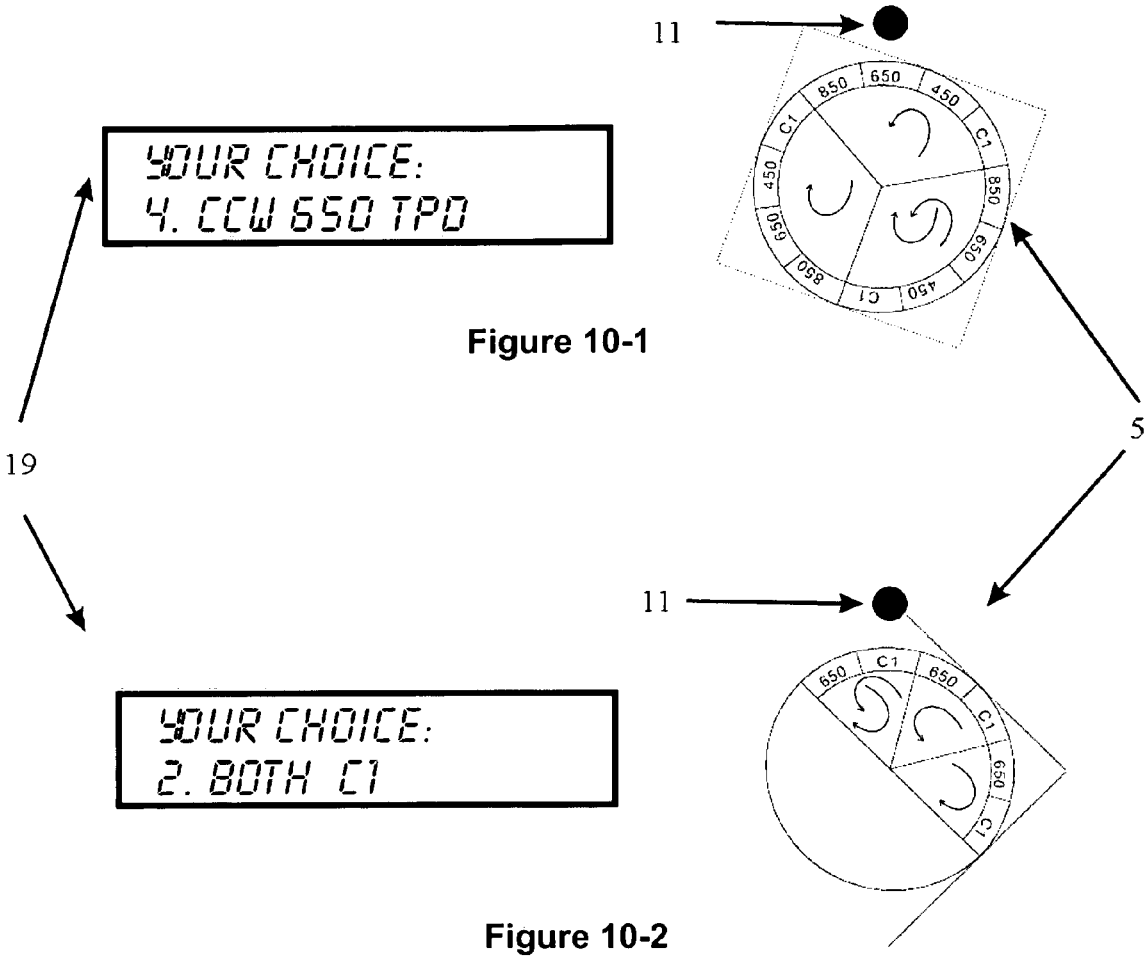

FIGS. 10-1 and 10-2 are drawings which explain two optional selector dial designs. In FIG. 10-1, the selecting knob 5 is turned so that the dial shows counter clockwise 650 turns-per-day is just under the LED 11. In this example, the rotator 5 allows the user to choose from 1 of the 12 functions. By aligning the program name to the LED light 11, the LCD panel 19 displays the appropriate function name, it is program #4, Counter Clockwise 650 Turns per Day.

In FIG. 10-2, the selecting knob 5 is so turned that the dial shows both direction, continuous 1 hour is just under the LED 11. In doing so, the LCD panel 19 shows user's choice is: program #2, both direction, continuous 1 hour. In this example, the rotator 5 allows the user to choose from 1 of the 6 functions.

Figures 1, 2, 11:
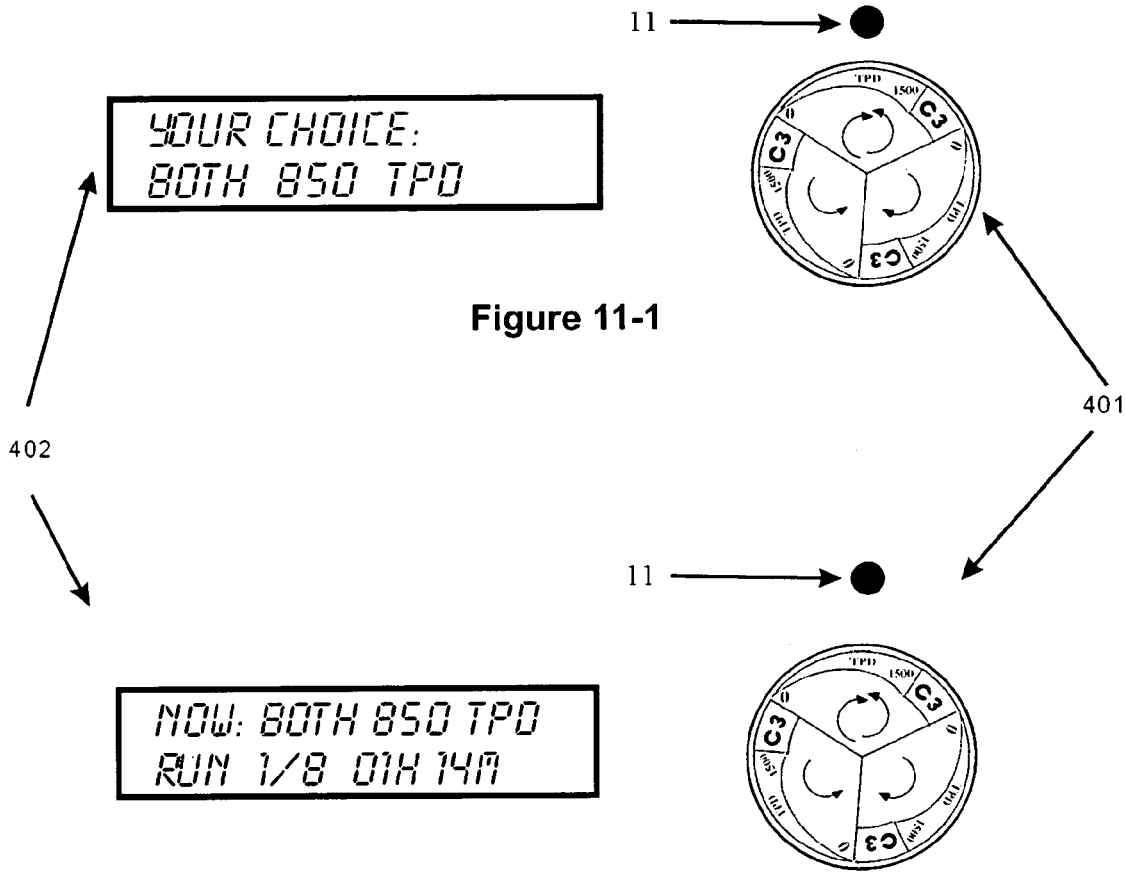

FIGS. 11-1 and 11-2 are drawings for explaining another two optional selector dial designs. In FIG. 11-1, the rotator (selecting knob) 5 allows the user to choose from any TPD (turns per day) from 1 to 1500 stepless or a C3 (continuous 3 hours).

In FIG. 11-2, the rotator 5 is put at both direction, 850 TPD, and the LCD panel 19 shows that this apparatus is in running, at the 1$^{st}$ out of 8 sessions, 1 hour 14 minutes left until the next session.

Figures 1, 2, 12:
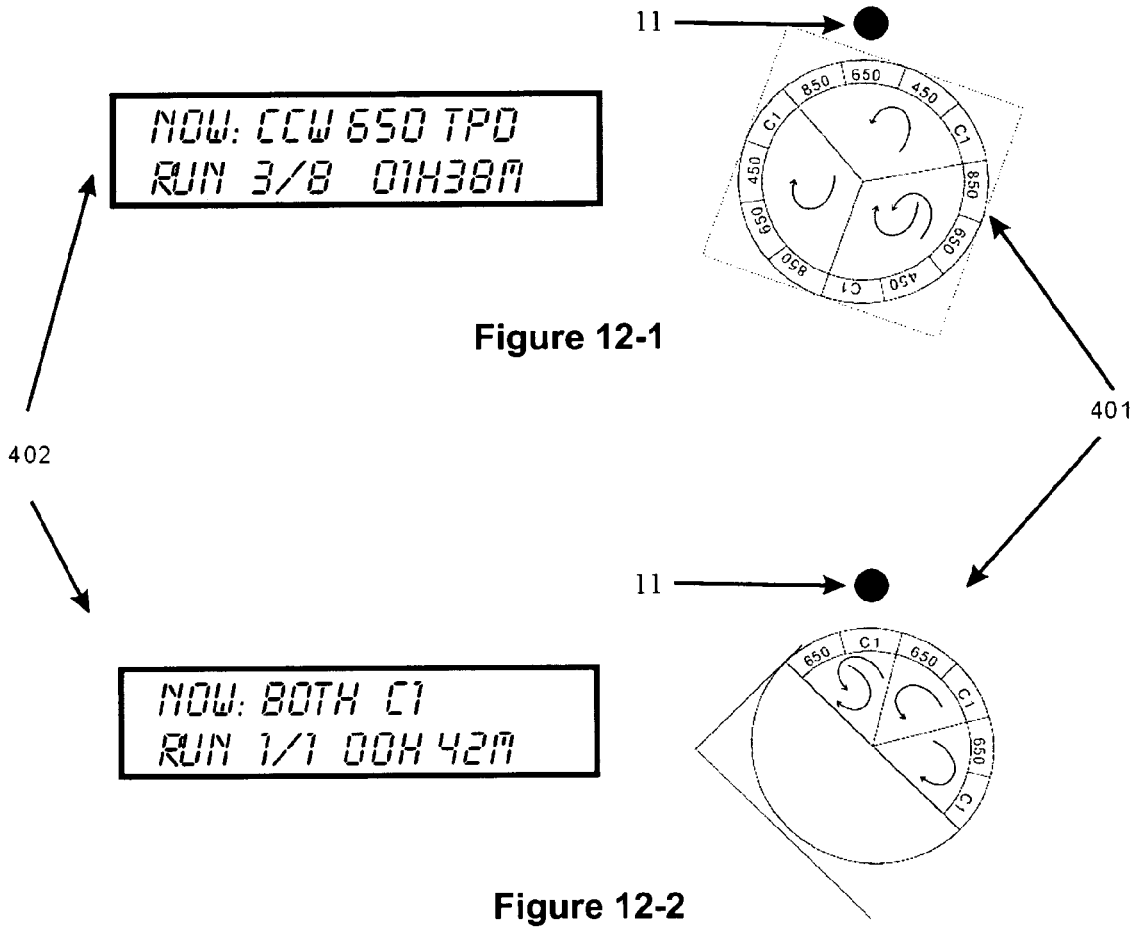

FIGS. 12-1 and 12-2 are drawings which explain further two optional selector dial designs. In FIG. 12-1, the LCD panel 19 displays the current program selected being CCW 650 TPD, which means counter clockwise 650 turns per day. RUN 3/8 01H38M means it is currently in "RUN" mode, at the 3$^{rd}$ out of 8 sessions, 1 hour 38 minutes left until the next session. The "Mode" will show either "RUN", "REST" or "SLEEP". The "Session" number will change as it advances. The time remaining indicator will change as time progresses. Auto Daily Repeat is built into the program which means the same program will repeat every 24 hours.

In FIG. 12-2, the LCD panel 19 displays the current program selected being BOTH C1, meaning alternating both direction periodically, RUN 1/1 00H 42M meaning it is currently in "RUN" mode, at the 1$^{st}$ out of 1 session, 42 minutes left until the next session (SLEEP MODE). The "Mode" will show either "RUN", "REST" or "SLEEP". The "Session" number will change as it advances. The time remaining indicator will change as time progresses. Auto Daily Repeat is built into the program which means the same program will repeat every 24 hours.

In any one of FIG. 10-1 to FIG. 12-2, while the rotator 5 is being turned, the LCD screen shows the function the user selected. If there is no further action after 5 seconds, the watch winder I. C. assumes the right selection is made and the machine starts at this time. Users can at any time change their mind by dialing to a different function. The new change will take effect after 5 seconds. This time differential is just for example only and could be changed later by the amending the software. The functions available can also be written/changed as necessary.

The watch-winding apparatus described is more sophisticated than that of prior art U.S. application Ser. No. 10/895,528. This results from a more complicated electronic circuitry. For example, the circuitry of prior art has no sensor while the circuitry of this invention uses a magnetic sensor for detecting the movement of the rotating tray 7. When the tray 7 swings over 70 degrees, the sensor output a signal to the computer on PCB. Once the on/off switch 17 is switched on, the locking circuitry is also activated and the tray 7 is locked. The tray 7 is always to be locked on its horizontal position.

Figure 13A:
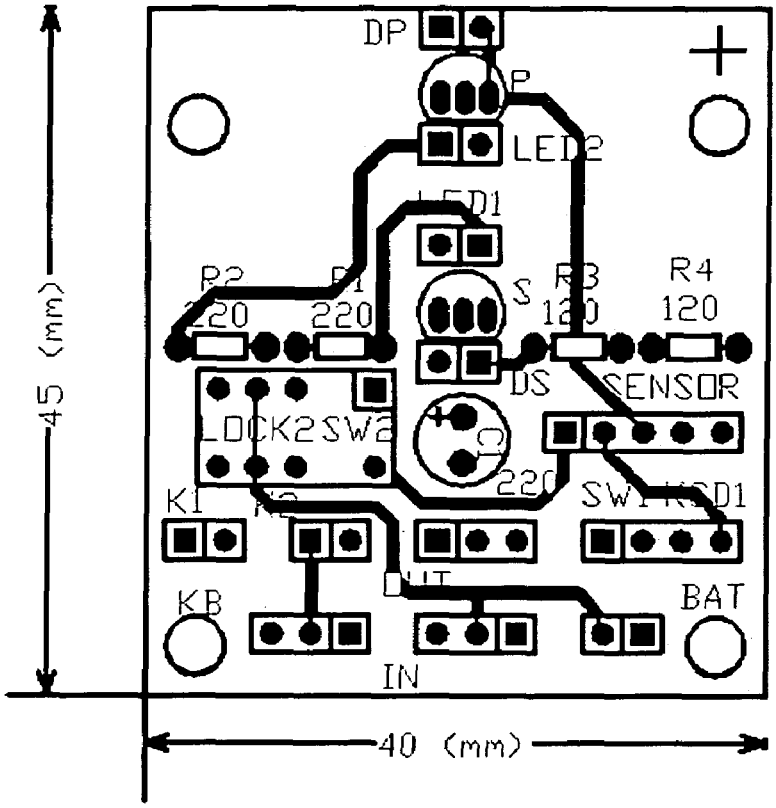
FIGS. 13A and 13B are top and bottom side views, partly in diagrammatic form, of a double-sided PCB for the magnetic sensor circuitry for a watch-winder.
Figure 13B:
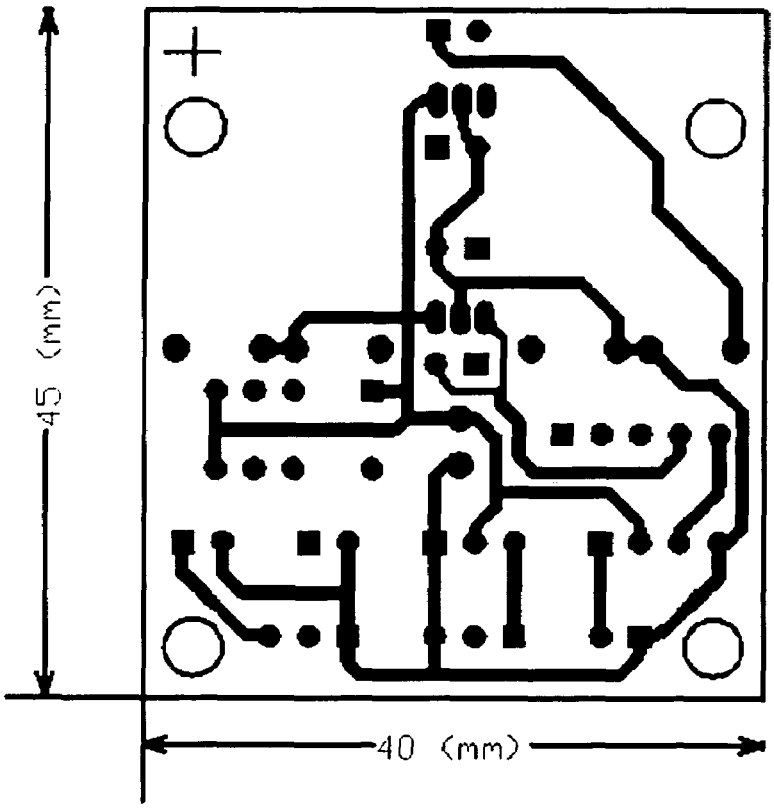
Figure 14:
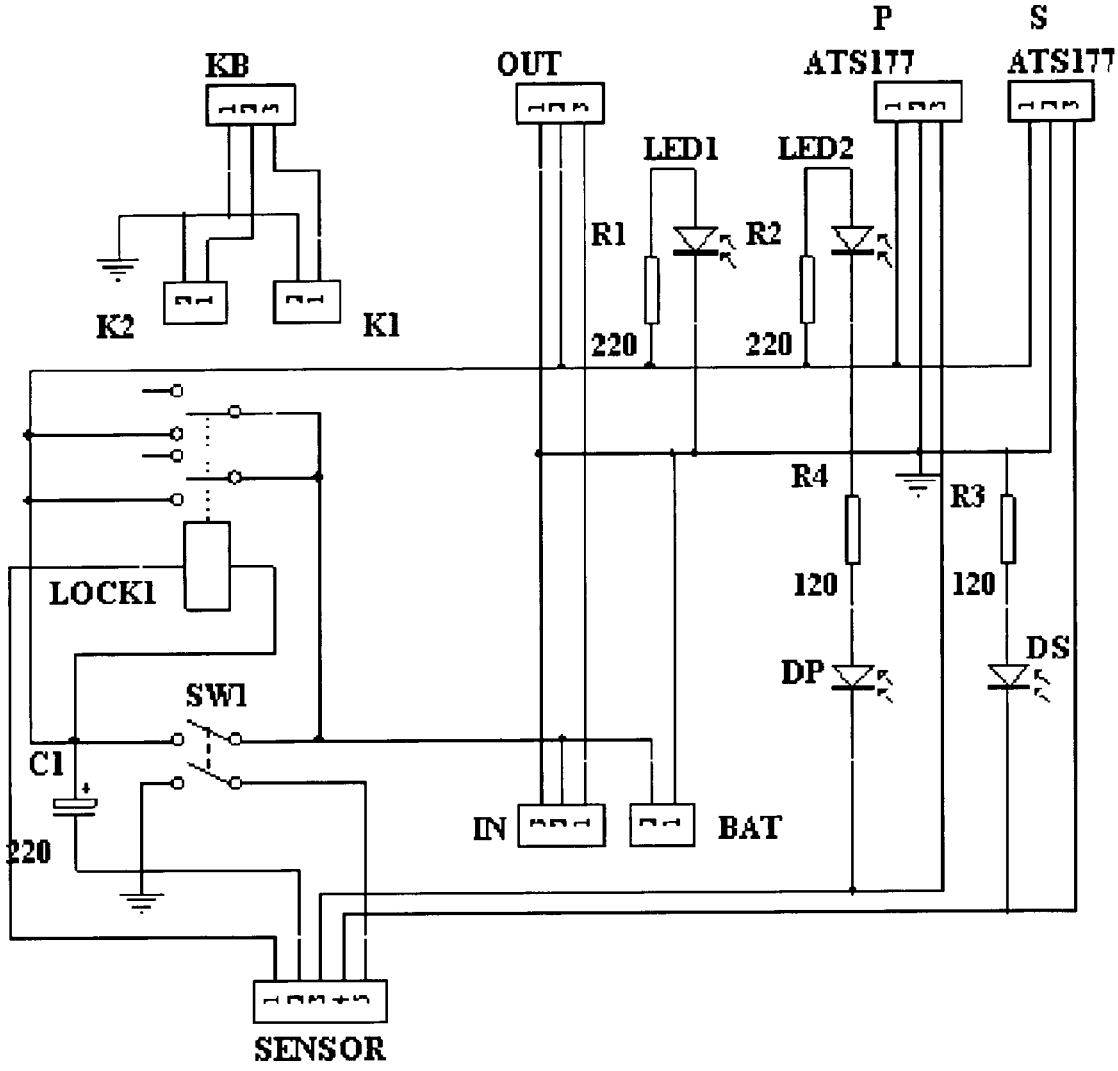
FIG. 14 is a circuit diagram of the sensor PCB in FIG. 13.

FIG. 13 is a double-sided PCB for the magnetic sensor circuitry. FIG. 14 is a circuit diagram of the sensor PCB in FIG. 13. FIG. 15 is an explanatory list for FIG. 13 and FIG. 14.

Figure 16:
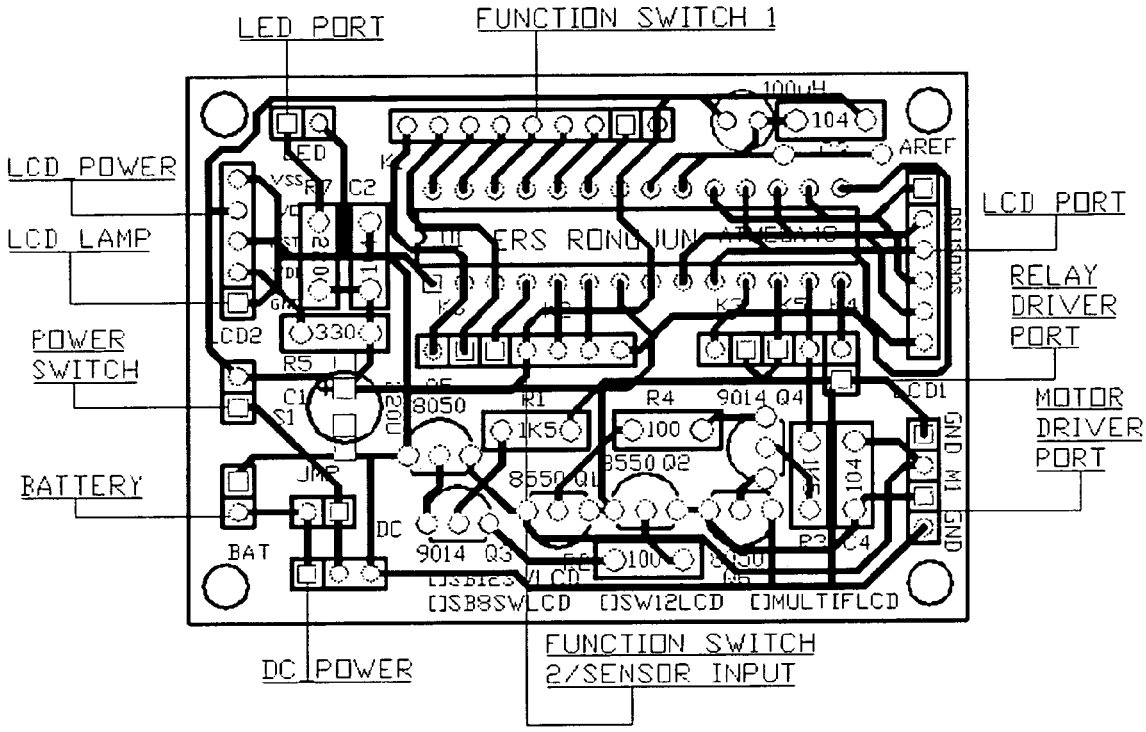
FIG. 16 is a top view, partly annotated, of the main PCB for the winder.
Figure 17:
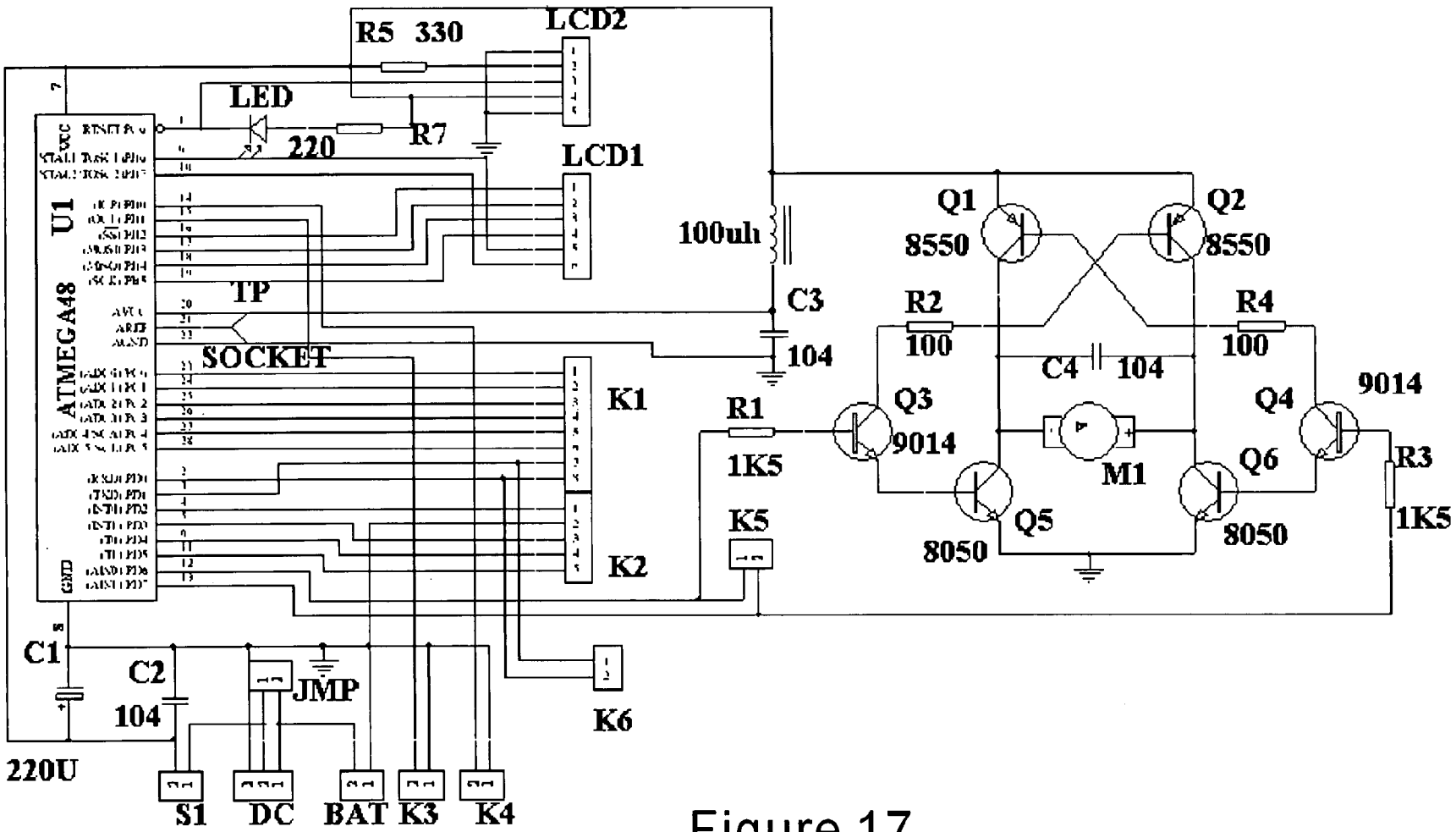
FIG. 17 is a circuit diagram of the PCB in FIG. 16.

FIG. 16 is the main PCB for the winder. FIG. 17 is a circuit diagram of the PCB in FIG. 16. FIG. 18 is an explanatory list for FIG. 16 and FIG. 17. This is very similar to FIG. 13 to FIG. 15. Simply speaking, the PCB in FIG. 13 is used for the magnetic sensor and the PCB in FIG. 16 is used for the winder.

All hard wares such as the motor 90, the tray 7, the automatic locking means, the sensors, the LCD panel 19, etc., cooperate with this electronic system (mainly comprised by the PCB) to perform all functions. FIG. 15 and FIG. 18 clearly discloses what components are used and what functions are then achieved.

All new features mentioned in this application can be used in a new product simultaneously. Alternatively, only a portion of the disclosed new features may be employed in a new product for economic reasons. As has been mentioned above, since the watch-winder 300 has a body 705 which can be opened from the bottom support 14, the drawer 204 is not necessary.

FIGS. 19, 20, 20-1 are simplified designs. In the drawings, LCD panel 11 has been omitted.

FIGS. 21A through 21P show further optional simplified designs. In this FIG. 21G, is simplified from the embodiment of FIG. 4, in that all frames 6 and the drawer 204 are omitted. While FIG. 21C, which is also simplified from the embodiment of FIG. 4, the LCD panel 11 is omitted. In FIG. 21C, which is also derived from the embodiment of FIG. 4, all frames 6, the drawer 204 and the LCD panel are omitted. The similar condition occurs in FIG. 21M (the original type) and FIG. 21N (LCD panel 19 has been omitted), FIG. 21G (the drawer 204 has been omitted), FIG. 21D (LCD panel 19, drawer 204, both drawer 204 and LCD panel 19 are omitted). FIG. 21H is a single-watch winder without LCD panel 19 and FIG. 21L is a simplified type from said FIG. 21H with the drawer 204 omitted.

Figures 1, 21:
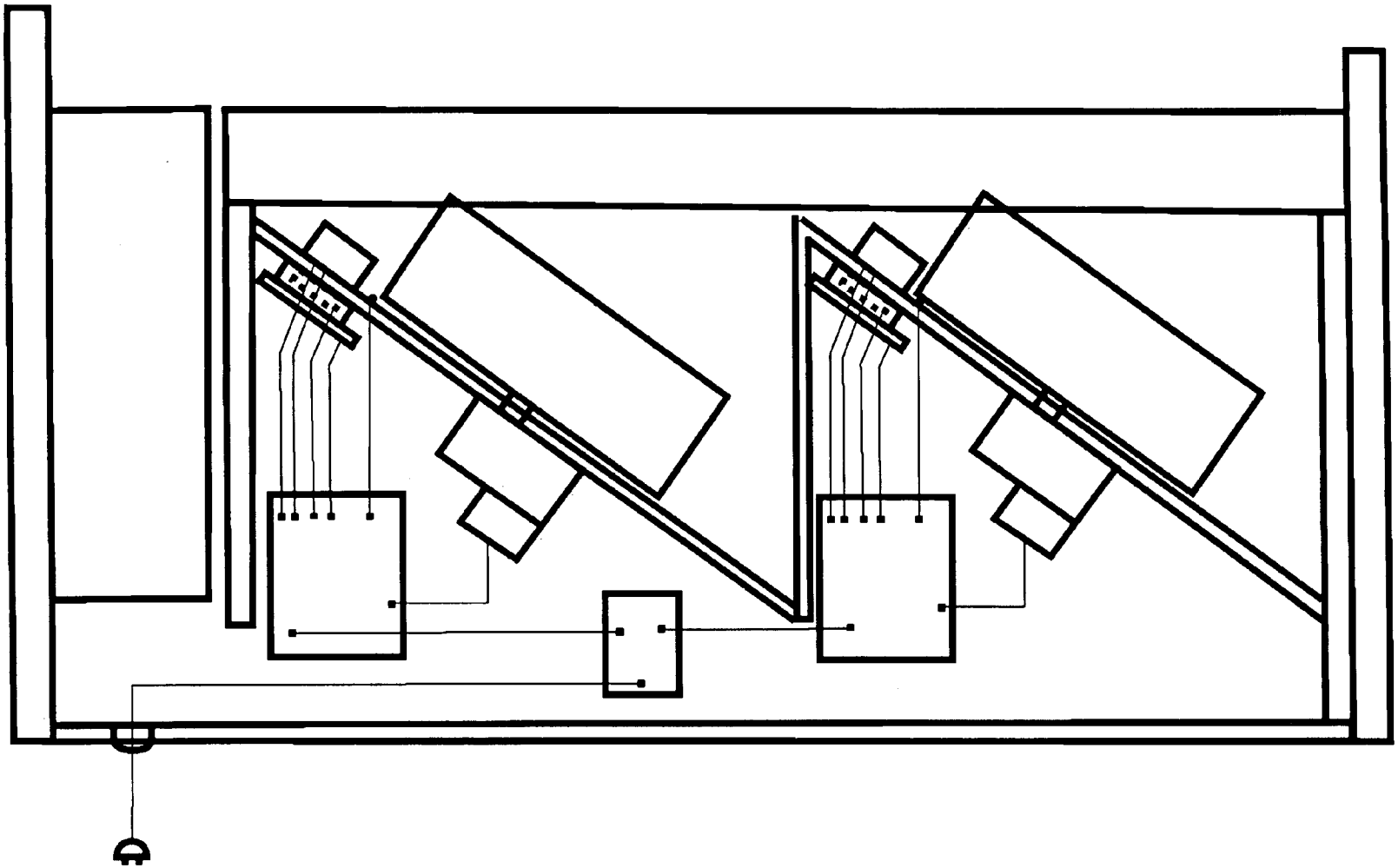

FIG. 21-1 is a simplified cross section view of the winder of FIG. 21A.

FIG. 22-A is a perspective view of an 8-watch winder with swivel center display, with the door closed. FIG. 22-B is a perspective view of an 8-watch winder with swivel center display, with the door opened. FIG. 22-C is a cross section view of the 8-watch winder with center swivel display. FIGS. 22-A to 22-C show another kind of embodiment. This kind of embodiment has the following features:

1. Four separate rotation bowls, each housing two watch spring cushions for two watches. Additional watch storage is provided on the lid interior. The lid flip cover is locked to the lid by a turning catch 224 in metal. In FIG. 22-B, 221 are lock pins, 223 is the lock, 222 is the lock pin hole, 225 is the battery compartment door, 226 is the center swivel display, 227 is the program selector for center swivel display, 228 is the instant action button for center swivel display.

2. In the center section, there is a swivel watch display 226 which houses six watches on each side. The unique feature is that the rotation of this display 226 from front to back is driven by a motor (with gear box) 233 (see FIG. 22-C), at 180 degree each rotation (that means the side with watches displayed always in open visual position). The bearing wheels 234 at the bottom of the display unit serve as a circular path. This is achieved by having two magnets 231 built on the top of the display 226, positioned underneath the magnetic sensor 230 of the circuit board 232 on the top portion. The 180 degree rotation procedure is as follows:

2.1 User can either manually push button 228 for instant change of direction or 2.2 User can turn on the program button 227 so that the turning of the display 226 can be on at a pre-programmed interval of period (say every 15 seconds). User however can always have instant rotation by over-riding this programmed interval by manually pushing button 228.

2.3 When button 228 is pushed, the motor 233 starts working. When the sensor 230 at the circuit board 232 senses the magnet 231 on the rotation display 226, the electronic circuit stops the motor 233 by turning its power source to OFF. Alternatively, if on preprogrammed mode by switching on button 227, the circuit will give command to turn ON the motor power every 15 seconds. Every time the sensor 230 senses the magnetic signal, it will turn the motor power to OFF.

3. This feature is very nice for people who like to see the watches on either side of the display at a push of button, or as a display 226 rotating 180 degrees every 15 seconds.

4. This unit also features a one-lock feature that can close the lid as well as the two side doors at the same time. This is achieved by having 3 lock pins 223 on the lid. When the two side doors are closed and the lid closes as well, the lock pins 223 will align against the three lock pin holes 222. By locking the center lock 223 with a key, all the doors are closed.

5. The flip cover on the lid is secured by closing and catched by the turning catch 224 on the lid so that the watches will stay in place even by having the lid closed downward. Besides, In FIG. 22-C, 240 is the DC plug input, 241 is the master power ON/OFF switch, 243 is the individual motor power ON/OFF switch.

What is claimed:

1. An improved watch-winding apparatus comprising:

a body;

a frame pivotally mounted to said body for pivotable movement relative to said body about a first axis;

a tray pivotally mounted to said frame for pivotable movement relative to said frame about a second axis; wherein at least one watch is mounted on said tray;

a motor having a drive axis; and a drive connector assembly connected to said tray and driven by said motor so that said tray moves in a circular wobbling movement relative to said drive axis.

2. The improved watch-winding apparatus of claim 1, wherein said connector assembly comprises a rod fixed to a central underside of said tray and said motor connects to said rod by a second connector at a location offset from said drive axis.

3. The improved watch-winding apparatus of claim 1, wherein said frame is a gimbal frame.

4. The improved watch-winding apparatus of claim 1, wherein the frame is mounted to the body by a pair of axially spaced pivot pins.

5. The improved watch-winding apparatus of claim 1, wherein the tray has an axle having opposed end portions which are received in openings in said frame.

6. The improved watch-winding apparatus of claim 1, wherein said tray receives a spring cushion for a watch.

7. The improved watch-winding apparatus of claim 1, wherein said first axis is perpendicular to said second axis.

* * * * *